United States Patent [19]

Ito

[11] Patent Number: 4,737,748

[45] Date of Patent: Apr. 12, 1988

[54] COPYING MACHINE WITH SELECTIVE ILLUMINATIONS

[75] Inventor: Masazumi Ito, Toyohashi, Japan

[73] Assignee: Minolta Camera Kabushiki Kaisha, Osaka, Japan

[21] Appl. No.: 756,941

[22] Filed: Jul. 18, 1985

[30] Foreign Application Priority Data

| | | | |
|---|---|---|---|
| Jul. 20, 1984 | [JP] | Japan | 59-151770 |
| Jul. 24, 1984 | [JP] | Japan | 59-154626 |
| Jul. 24, 1984 | [JP] | Japan | 59-154627 |
| Aug. 1, 1984 | [JP] | Japan | 59-163341 |

[51] Int. Cl.[4] ..... G03G 15/04

[52] U.S. Cl. ..... 355/14 R; 355/7; 355/14 E; 355/70; 355/8

[58] Field of Search ..... 355/3 ER, 14 E, 14 R, 355/14 CH, 14 C, 67, 3 CH, , 3 TE, 7–8, 14 ER, 69–70

[56] References Cited

U.S. PATENT DOCUMENTS

| | | | |
|---|---|---|---|
| 3,752,558 | 8/1973 | Lloyd | 350/6 |
| 3,967,893 | 7/1976 | Mayewicz | 355/8 X |
| 4,153,364 | 5/1979 | Suzuki et al. | 355/8 X |
| 4,255,042 | 3/1981 | Armitage, Jr. et al. | 355/70 X |
| 4,256,400 | 3/1981 | Komori et al. | 355/7 X |
| 4,260,248 | 4/1981 | Murata et al. | 355/14 C X |
| 4,338,020 | 7/1982 | Yukawa et al. | 355/8 X |

FOREIGN PATENT DOCUMENTS

| | | | |
|---|---|---|---|
| 0066187 | 12/1982 | European Pat. Off. | 355/14 E |
| 55-53325 | 4/1980 | Japan . | |
| 56-40853 | 4/1981 | Japan . | |
| 57-02057 | 1/1982 | Japan | 355/14 E |
| 57-6863 | 1/1982 | Japan . | |
| 57-68877 | 4/1982 | Japan . | |
| 57-142662 | 9/1982 | Japan . | |
| 57-188071 | 11/1982 | Japan | 355/14 E |
| 58-87566 | 5/1983 | Japan . | |
| 58-144851 | 8/1983 | Japan | 355/8 |
| 58-176632 | 10/1983 | Japan | 355/70 |
| 59-93468 | 5/1984 | Japan | 355/14 E |
| 59-88757 | 5/1984 | Japan | 355/14 E |

*Primary Examiner*—A. T. Grimley
*Assistant Examiner*—Jane K. Lau
*Attorney, Agent, or Firm*—Price, Gess & Ubell

[57] ABSTRACT

A copying machine having a first plurality of individual light emitting elements can be selectively illuminated depending on the copy size desired. Corresponding second array of light emitting elements can define an erasing apparatus positioned adjacent a photosensitvie member. An operator can designate the area to be copied. Control apparatus can control the individual light emitting elements based on the set predetermined copying conditions.

20 Claims, 34 Drawing Sheets

O.R.L. : LENGTH OF ORIGNAL
P.L. : PAPER LENGTH
REG : PEGISTER
P.W : PAPER WIDTH
MAG : MAGNIFICATION

P.S. : PAPER SIZE

COPYING MACHINE WITH SELECTIVE ILLUMINATIONS

FIELD OF THE INVENTION

The present invention relates to a copying machine and more particularly to a copying machine comprising an illumination device having a plurality of light emitting elements aligned in a row with each of the light emitting elements being independently turned on or off.

BACKGROUND OF THE INVENTION

In a conventional electrophotographic copying machine, only one straight elongated linear tubular lamp is used for illuminating an original to be copied. The light image of the original can be transferred to a photosensitive member by scanning the tubular lamp with a scanning mirror under a platen on which the original is placed. The lamps most frequently used have such arrangement that a plurality of filaments for illumination are suspended in the tube with a predetermined equal space and the respective filaments are connected in series. In the copying machine using only one tubular lamp of the type as described above, if one of the filaments is cut, the copying machine can not be used.

In the technical field to which the present invention pertains, it has been considered that only such elongated lamp could be used and the lamp should illuminate over the entire width of the platen simultaneously. However, according to the technical knowledge of the present inventors, there is no reason to illuminate the over all width of the platform for all kinds of size of an original.

SUMMARY OF THE INVENTION

An essential object of the present invention is to provide a copying machine which is able to make a copy by illuminating only a desired part of the original.

Another object of the present invention is to provide a copying machine which is able to make a copy even if there occurs a partial fault in the light emitting device for illuminating the original.

A still further object of the present invention is to provide a copying machine which is able to notice whether the required part of the original can be copied on the selected paper prior to actually making the copy.

To accomplish the above objects, according to the present invention there is provided a copying machine for copying an image of an original placed on a transparent platform by illuminating the original and projecting the image of the original on a photosensitive member using a slit system, said copying machine comprising;

an original illuminating means having a plurality of light emitting elements lined up in a row and movable relative to the original;

erasing means having a plurality of light emitting elements disposed corresponding to the respective light emitting elements of the original illuminating means with one to one relation and lined up in a row so as to oppose the photosensitive member, and control means for controlling turning on and off of the respective light emitting elements of the original illuminating means and the erasing means based on copying conditions.

The present invention has been made on the basis of the knowledge of the inventors as described above using a plurality of illumination lamps divided in the direction of the width of the platform.

Actually when a plurality of light emitting elements divided in the width direction of the platform are used, there can be obtained various advantages.

In case one of the light emitting elements is damaged, copying machine is still available using the light emitting elements that are operating well. The user of the copying machine can still make a copy even if there is some fault in the copy in case of an emergency.

Further, the number of the light emitting elements that can be turned on can be defined as desired for example depending on the size of the original so as to prevent unnecessary light from entering to the operators eyes even if a copy is performed with the cover for covering the original opened. In addition, turning on the light emitting elements partly enables to illuminate only the necessary part of the original for making a partial copy.

In case of a partial copy, by turning on only the necessary part of the light emitting elements, and by scanning the original by the light emitting elements which are turned on with a low speed, the user can see whether or not the necessary part of the original is scanned by the light passing through the original.

Still further, the light intensity of each of the light emitting elements can be changed independently. Therefore, by controlling the light intensity of each of the light emitting elements by the signals of the light receiving elements each disposed to receive the light reflected from a part of the original illuminated by the corresponding light emitting element so that a copy having a uniform printing density can be obtained even if the density of the original is different part by part.

DETAILED DESCRIPTION OF A PREFERRED EMBODIMENT

Copying Mechanism

Figure 1:
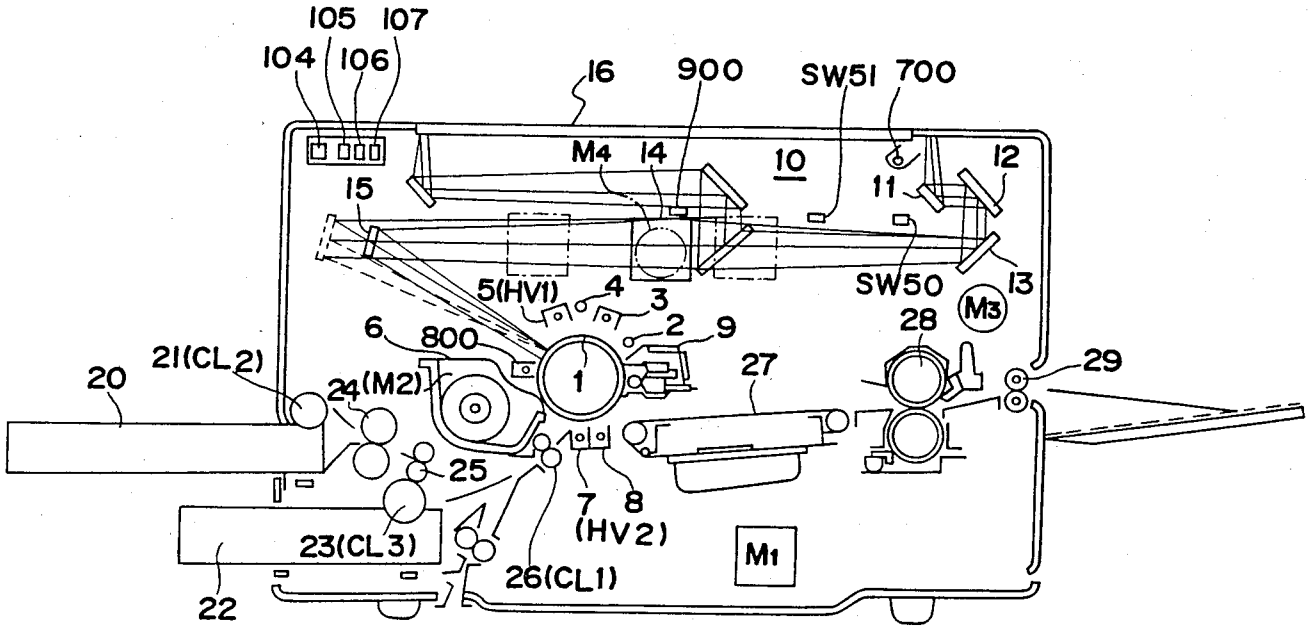
FIG. 1 is a schematic diagram showing one example of a copying machine to which the present invention is applied.

Referring to FIG. 1 of the drawings, there is shown *an example of an electrophotographic copying apparatus*. The electrophotographic copying apparatus comprises a photoreceptor drum 1 provided substantially at the central portion of the apparatus for rotation in the counterclockwise direction, and a main eraser lamp 2, a sub corona charger 3, a sub eraser lamp 4, a main corona charger 5, LED (light emitting diode) array 800 for erasing unnecessary charges, a developing device 6, a transfer charger 7, a copy paper separation charger 8 and a blade type residual toner cleaning device 9 disposed around the photoreceptor drum 1. The photoreceptor drum 1 has a photosensitive layer formed on its cylindrical surface, which is sensitized and charged by passing through the eraser lamps 2 and 4 and the corona chargers 3 and 5. The photoreceptor drum 1 receives an exposed image transferred from an original to be copied through an optical system 10.

The optical system 10 is provided under an original platform 16 for scanning an image of the original, which platform 16 is formed by transparent material such as glass, the optical system 10 comprises a light source 700, movable mirrors 11, 12 and 13, a projection lens 14 and a projection mirror 15. A DC motor M3 drives the light source and the movable mirrors 11, 12 and 13 so that the light source 700 and the movable mirror 11 are moved to the left in FIG. 1 at the same speed as the circumferential speed v of the photoreceptor drum 1 which is constant regardless of changes in copying magnification while the movable mirrors 12 and 13 are moved to the left in FIG. 1 at a speed of v/2n (n represents copying magnification and V represents the circumferential speed of the photoreceptor drum 1 and is constant regardless of changes in copying magnification). When the copying magnification is changed, the projection lens 14 is moved along the optical axis and the projection mirror 15 is moved along the optical axis with pivotal movement thereof, as hereinafter described with reference to a device for varying the copying magnification.

In the left-hand direction in FIG. 1 of the copying apparatus, there are provided copy paper cassettes 20 and 22 respectively having copy paper feeding rollers 21 and 23 while a path for the copy paper is formed by pairs of rollers 24 and 25, a pair of timing rollers 26, a transport belt 27, a fixing device 28 and a pair of discharged rollers 29.

Figure 3:
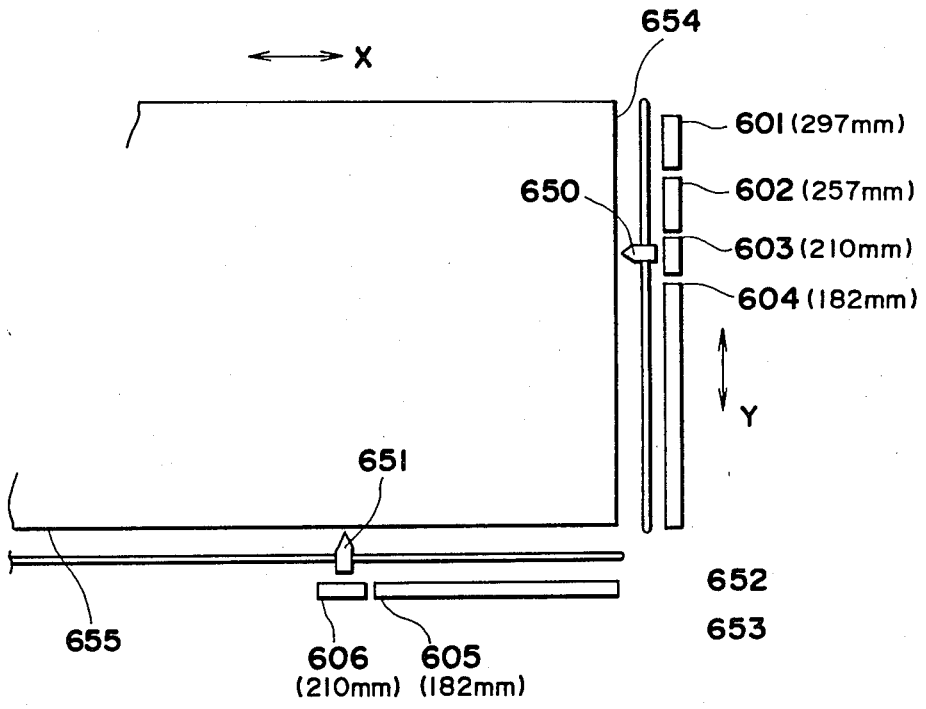
FIG. 3 is a partial plan view showing a light setting device.

Referring to FIG. 3, showing the top face of the copying machine, on which a first knob 650 and a second knob 651 are slidably provided in slots 652 and 653 defined along the lateral side 654 and the longitudinal side 655 of the original platform 16. The position of each of the knobs 650 and 651 is sensed by switches 601 through 604 so that the signal representing the position of the knobs that is the size of the original can be input to a control device shown in FIG. 5. The switches 601 through 606 are so arranged that when the knobs 650 and 651 are shifted along the slots 652 and 653 corresponding to the any one of the sizes A5, A4, B5 and so on, any one of the switches 601 through 606 can be turned on. In order to detect the longitudinal attitude or lateral attitude of the original of A4 or B5, any one of the switches 605 or 606 is turned on by shifting the knob 651. The terms of longitudinal attitude or lateral attitude of the original, means that the original is placed on the platform 16 with its longitudinal direction aligned to the longitudinal direction X of the platform 16 or the original is put on the platform 16 with its longitudinal direction aligned to the lateral direction Y.

By combination of the operation of the switches 601 through 604, 605 and 606 what papers of any one of A3 size or A4 size papers in the longitudinal attitude, A4 size paper in the lateral attitude, A5 size paper, B4 size paper or B5 size paper in the lateral attitude is placed on the original platform 16 can be detected.

In the preferred embodiment, the copying magnification can be set within the range from ×0.647 to ×1.414 by a change of the magnification unit of 0.001, so that the copying magnification can be changed substantially continuously. In order to perform the magnification change, the lens 14 is adapted to be moved in the light path by the motor M4. Further, the mirror 15 can be moved in the light path for correction of the complex length of the lens and the mirror 15 also can be slightly vibrated so as to make the incident point of the light to the photoreceptor drum 1 at the same position. The arrangement is the same as disclosed in the U.S. Pat. No. 4,543,643, which is cited in this invention for reference. When the lens 14 and mirror 15 are moved to the position corresponding to the designatied magnification value, the speed of the scanner can be set corresponding to the designated magnification, and the scanner performs the scanning upon application of a signal of starting the scan. As the control device for the scanning, the arrangement disclosed in U.S. Pat. No. 4,561,771 can be used.

Figure 4:
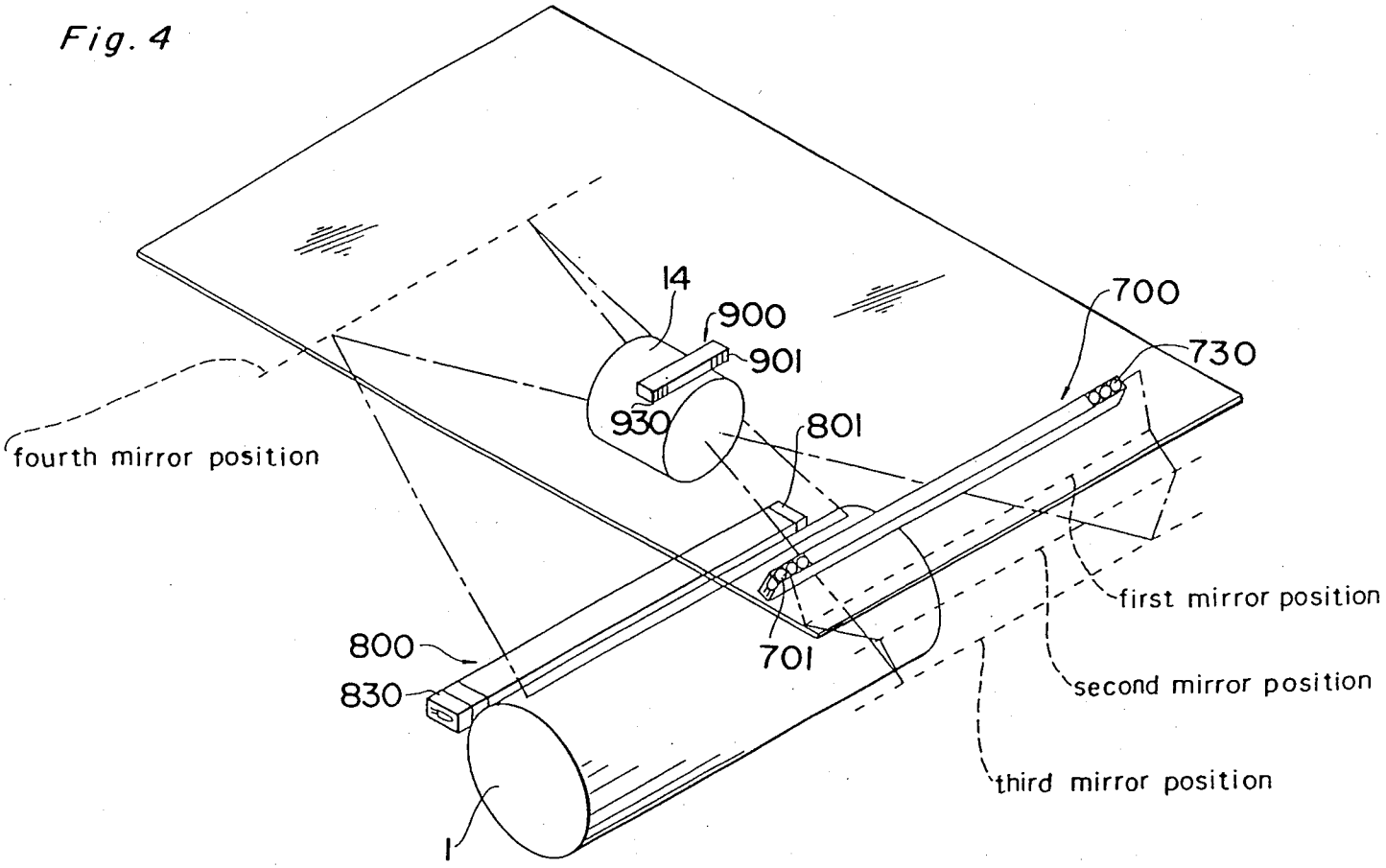
FIG. 4 is a partial perspective view showing an arrangement of light emitting elements and a photosensitive drum.

FIG. 4 shows an LEDs array 700 for illumination with the respective LEDs designated 701 through 730 and another LED array 800 for erasing unnecessary images present in the space between two images or in the space of the edge parts of the photoreceptor drum 1 with the respective LEDs designated by 801 through 830.

The respective LEDs are so arranged that a portion of the photoreceptor drum 1 to which the image of the portion of the original illuminated by the LED 701 corresponds to the area on the photoreceptor drum 1 to which the light of the LED 801 is projected. LEDs 702 through 730 and 802 through 830 are respectively arranged in the same manner as described above. In an optical path of the optical system 10, there is provided a photo diode array 900 which is constructed from a plurality of photo diodes 901 through 930 lined up in a row and disposed corresponding to the respective LEDs 701 through 730.

Control Device

Figure 2:
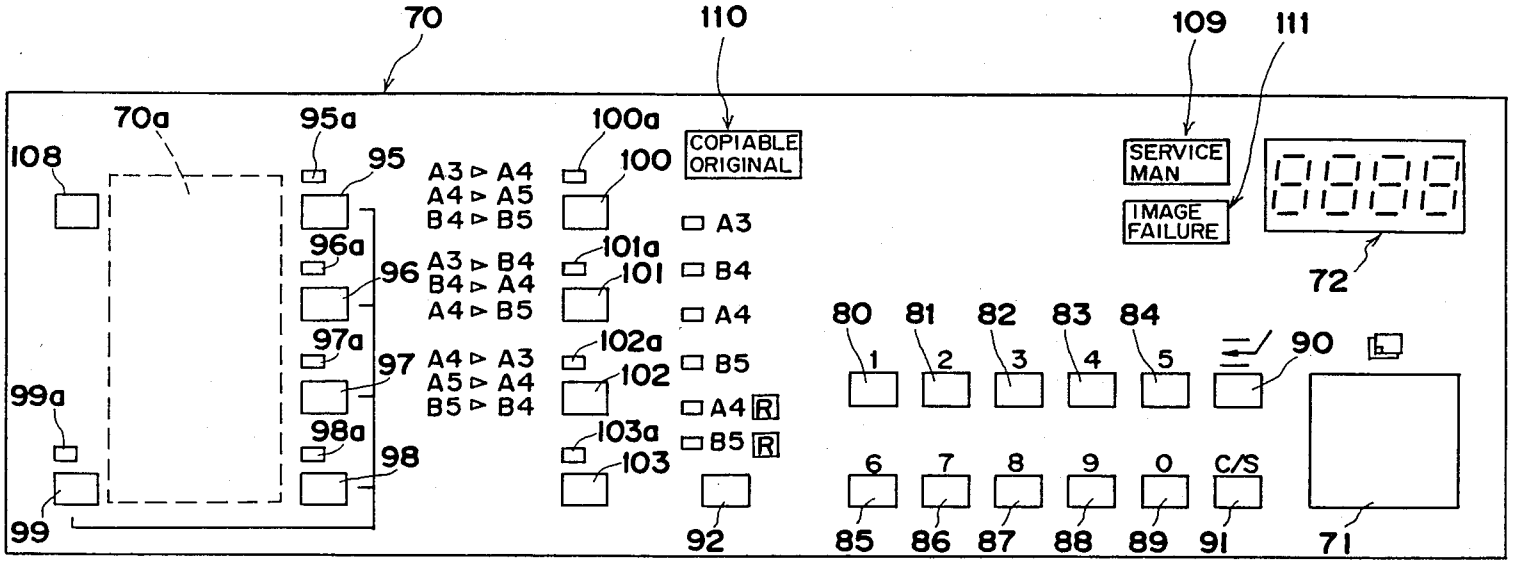
FIG. 2 is a top plan view showing one example of an operation panel used in the copying machine according to the present invention.

In FIG. 2, there is shown a control panel 70 of the copying apparatus with the arrangement of a print key 71 for starting a copying operation, a numerical value display device 72 indicative of a number of four figures, ten keys 80 through 89 respectively corresponding to 1, 2, . . . 9, 0, an interruption key 90 for designating an interruption of the copying operation, a clear stop key 91, a copy paper selection key 92 for selectively designating the size of the copy paper provided in a plurality of stages and a plurality of keys 95 to 103 forming the copying magnification setting selecting device.

A first group of copying magnification setting selection keys 95 through 98 are arranged for selectively setting the copying magnification, and when one of the keys 95 to 98 is operated in a condition that a first switching key 99 for switching a magnification setting mode is operated to switch the control mode of the copying apparatus to a first magnification setting mode, the numerical value input through the ten keys 80 to 89 and displayed on the display device 72 is stored as the copying magnification value in a memory location corresponding to the operated key 95 to 98.

With respect to a second group of magnification setting keys 100 through 103, a predetermined copying magnification is previously set in each of a plurality of respectively corresponding memory locations so that a copying operation can be carried out on the basis of a preset value, without the necessity of setting of such value as in the case of the aforementioned first group of keys. Therefore, the present copying magnification can be selected and set in e.g., the manufacturing process with values generally used by the user as hereinafter described in detail.

Thus, the first group of keys function to selectively set the copying magnification required by the user while for particular copying needs the second group of keys function to select preset copying magnification in the ratio of, e.g., A4 size to B5 size, B4 size to A4 size, A3 size to A4 size or A4 size to A3 size in case of copying apparatuses to be used in Japan. However, since the values preset with respect to the second group of keys are general or calculated copying magnifications, a mechanical error or an error in design might cause the magnification of an actually obtained copy to slightly deviate from the preset copying magnification. That is, even if an equal size magnification of $\times 1$ is selected, the actually obtained copy might be, e.g., in an enlarged size magnification of $\times 1.004$ or in a reduced size magnification of $\times 0.996$. In such a case, a desired copying magnification can be obtained by operating a second switching key 104 (FIG. 1) to switch the control mode of the copying apparatus to a second copying magnification setting mode and setting selected values in the memory locations corresponding to the keys 100 to 103 in a similar manner to the operation of the aforementioned first copying magnification setting mode. More particularly, a value of 1.002 or 0.998 may be set with respect to an equal size magnification key.

An original illuminating button 108 is provided on the control panel 70 for instructing to illuminate the original placed on the original platform 16 by the light of the LED array 700 so that the image of the original can be seen from above.

109 denotes a service man call lamp and 111 is a lamp for indicating that there is a fault of any one of the LEDs. A copy available display 110 (described as copiable original in FIG. 2) shows, with size indicators such as A3, B4 and so on, the available copy size under a condition that any one of the LEDs is in a failure mode.

Figure 5:
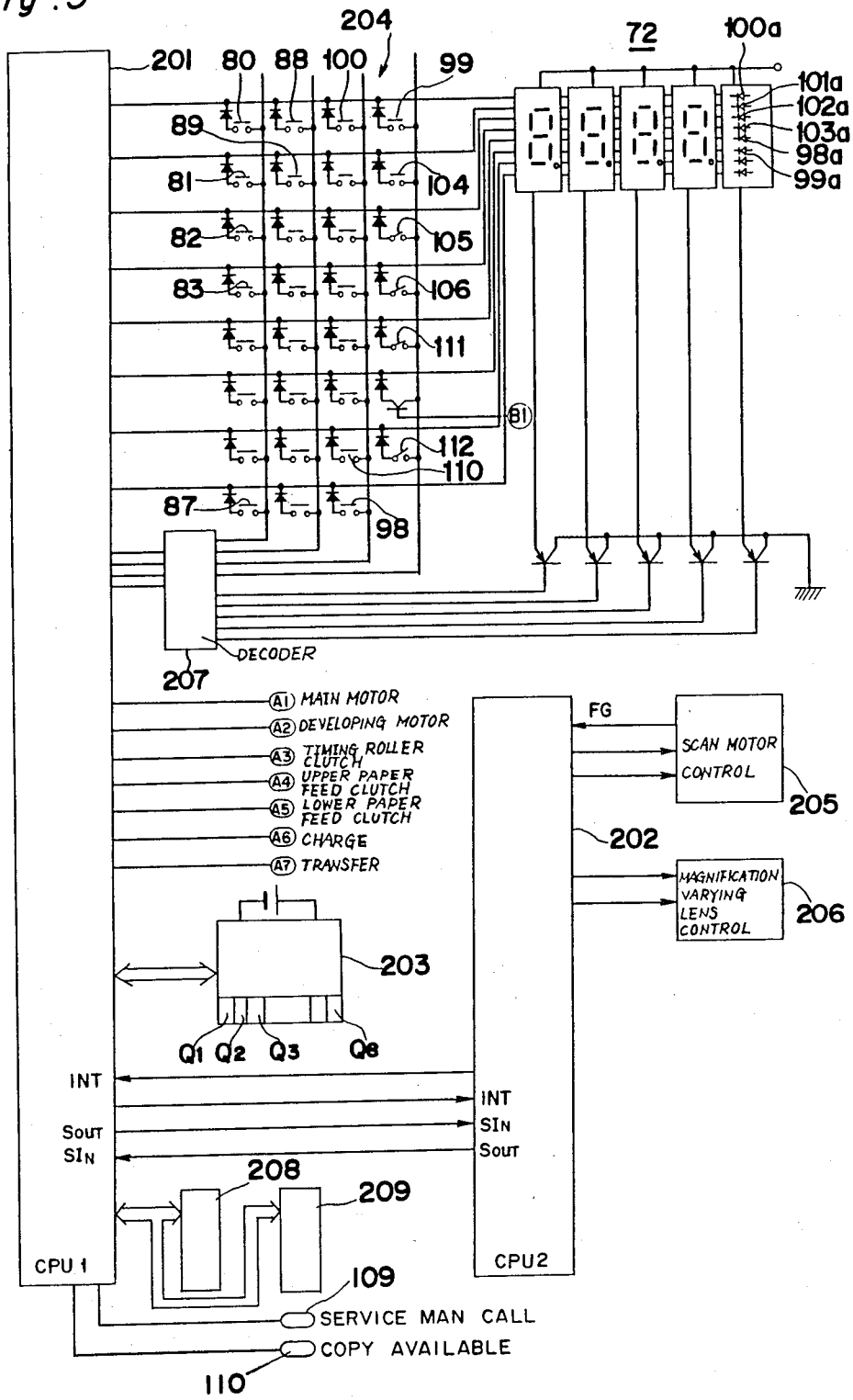
FIG. 5 is a schematic diagram showing a circuit arrangement of a control device of the copying machine according to the present invention.

In FIG. 5, there is shown a circuit for controlling the copying operation according to the present invention, which comprises a first CPU (central processing unit) 201, a second CPU 202, a RAM (random access memory) 203 backed up by batteries, a switch matrix 204, a driving circuit 205 for driving the DC motor M3 for scanning an original document to be copied, a driving circuit 206 for driving the stepping motor M4 for changing the copying magnification and a decoder 207. Output terminals A1 through A7 are respectively connected to switching transistors (not shown) for driving a main motor M1, a developing motor M3, a timing roller clutch 26 (CL1), an upper paper feeding clutch CL2, a lower paper feeding clutch 23 (CL3), the charger 5 (HV.1) and the transfer charger 7 respectively.

In general, the various data are processed in CPU in the form of a binary code. Therefore, the input data entered from the peripheral equipments or sensors are represented by predetermined binary codes. Table 1 shows examples of the binary codes indicating the size of the copy paper used in the copying machine in this preferred embodiment.

TABLE 1

| decimal code | binary code | paper size |
|---|---|---|
| 0 | 0 0 0 0 | |
| 1 | 0 0 0 1 | A6 longitudinal |
| 2 | 0 0 1 0 | B6 longitudinal |
| 3 | 0 0 1 1 | A5 longitudinal |
| 4 | 0 1 0 0 | B5 longitudinal |
| 5 | 0 1 0 1 | A4 longitudinal |
| 6 | 0 1 1 0 | B4 longitudinal |
| 7 | 0 1 1 1 | A3 longitudinal |
| 8 | 1 0 0 0 | |
| 9 | 1 0 0 1 | A5 lateral |
| 10 | 1 0 1 0 | B5 lateral |
| 11 | 1 0 1 1 | A4 lateral |
| 12 | 1 1 0 0 | B4 lateral |
| 13 | 1 1 0 1 | A3 lateral |
| 14 | 1 1 1 0 | |
| 15 | 1 1 1 1 | cassette empty |

Figure 6:
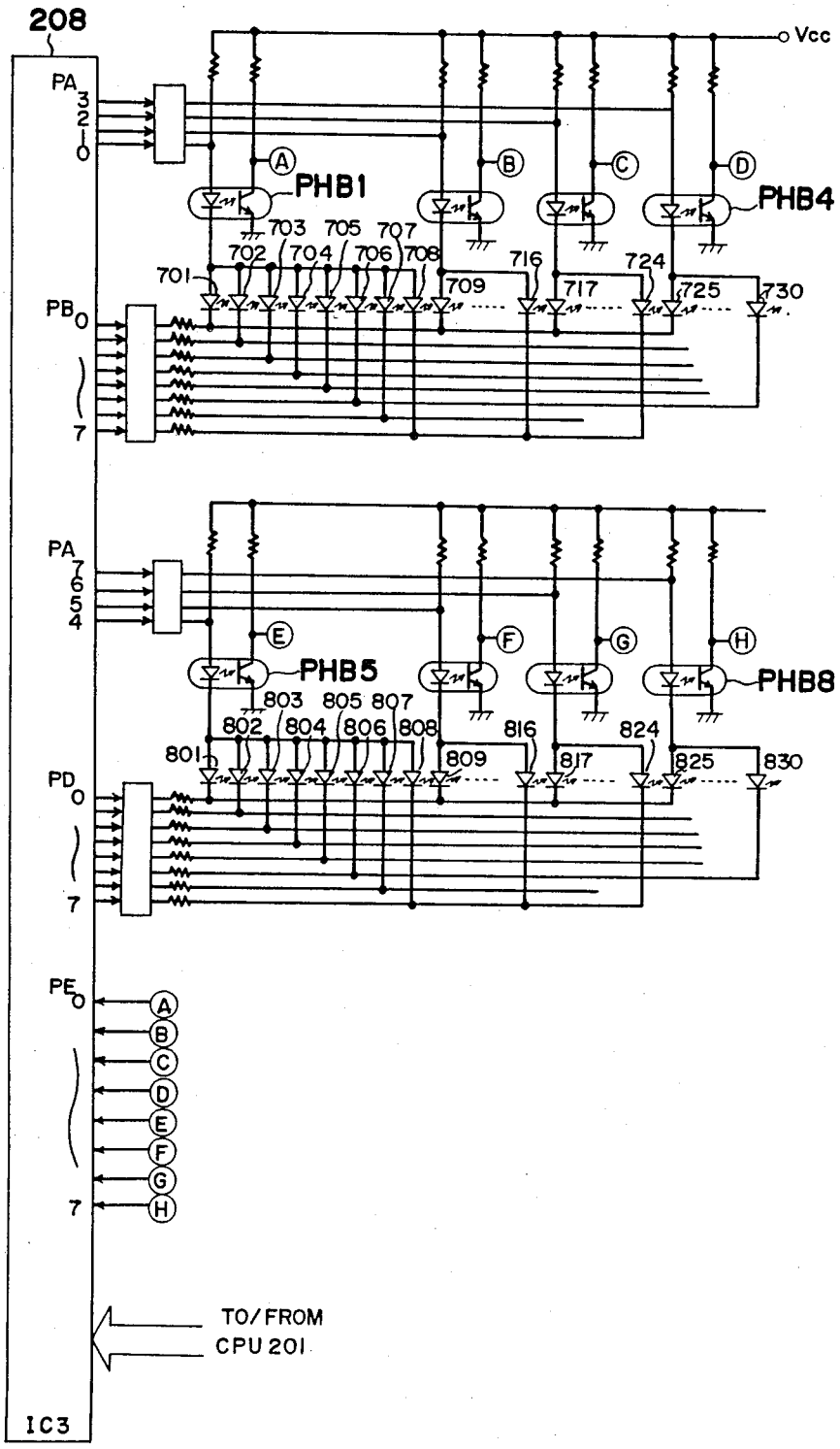
FIG. 6 is schematic circuit diagram of a light emitting device used in the copying machine according to the present invention.
Figure 7:
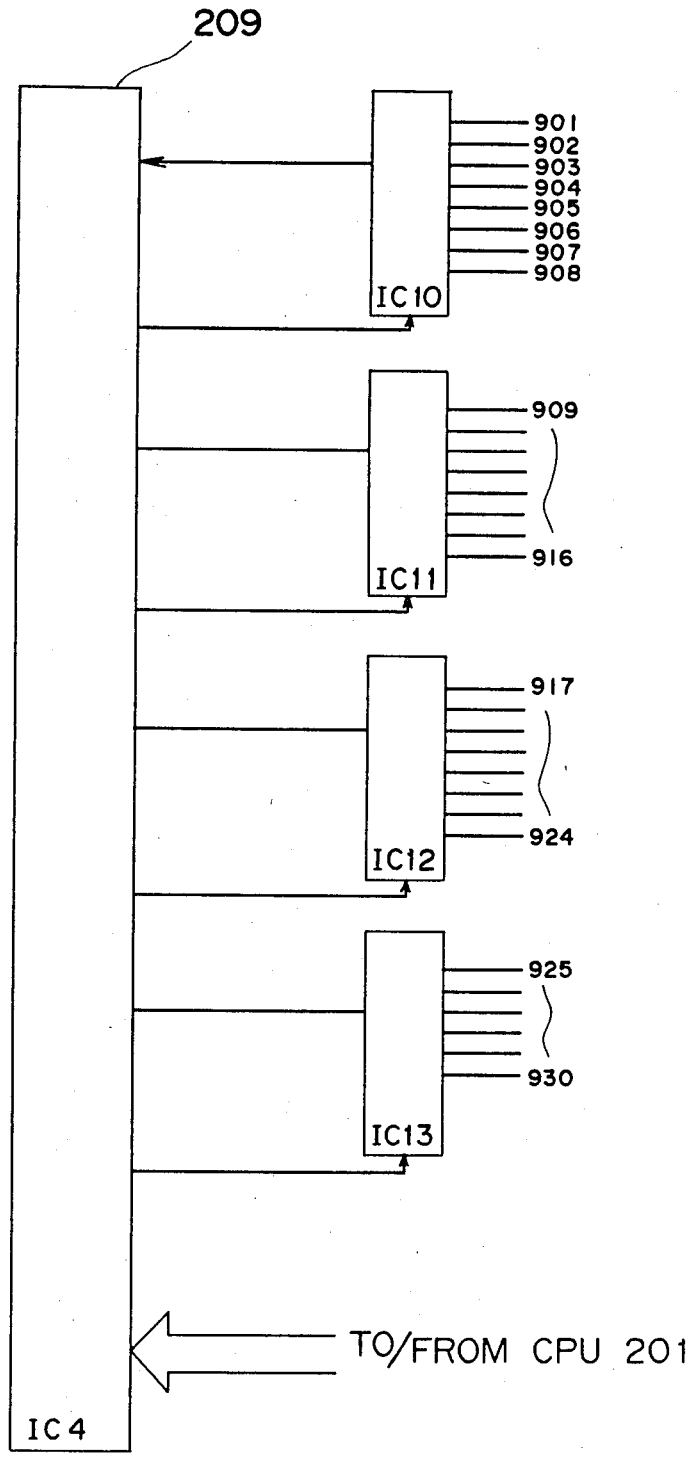
FIG. 7 is schematic circuit diagram of a photo diode array used in the copying machine according to the present invention.

In FIG. 5, a drive control circuit 208 is provided for controlling light emitting of the LED arrays 700 and 800 the detail of the circuits is shown in FIG. 6. 209 denotes a control circuit for receiving the light measurement value fed from the photo diode array 900 which is provided for detecting the density of the original to be copied, the detail of which is shown in FIG. 7.

Referring to FIG. 6, the terminal PA0 is connected with the LEDs 701 through 730 through a photo coupler PHB1. The LEDs 701 through 708 are connected with the terminals PB0 through PB7. Similar to this arrangement, LEDs 709 through 730 are connected with the ports PA and PB. LEDs 801 through 830 are respectively connected with the ports PA4 through PA7 and PD0 through PD7. Photo couplers PHB1 through PHB8 are connected with the ports PE0 through PE7 for detecting the fault condition of the respective LEDs. Referring to FIG. 7, photo diodes 901 through 930 are divided into four groups and connected with interfaces IC10 through IC13. The respective outputs of the interfaces IC10 through IC13 are connected with the fourth CPU 209 for inputting the light measurement values of the photo diodes 901 through 930.

Figure 8:
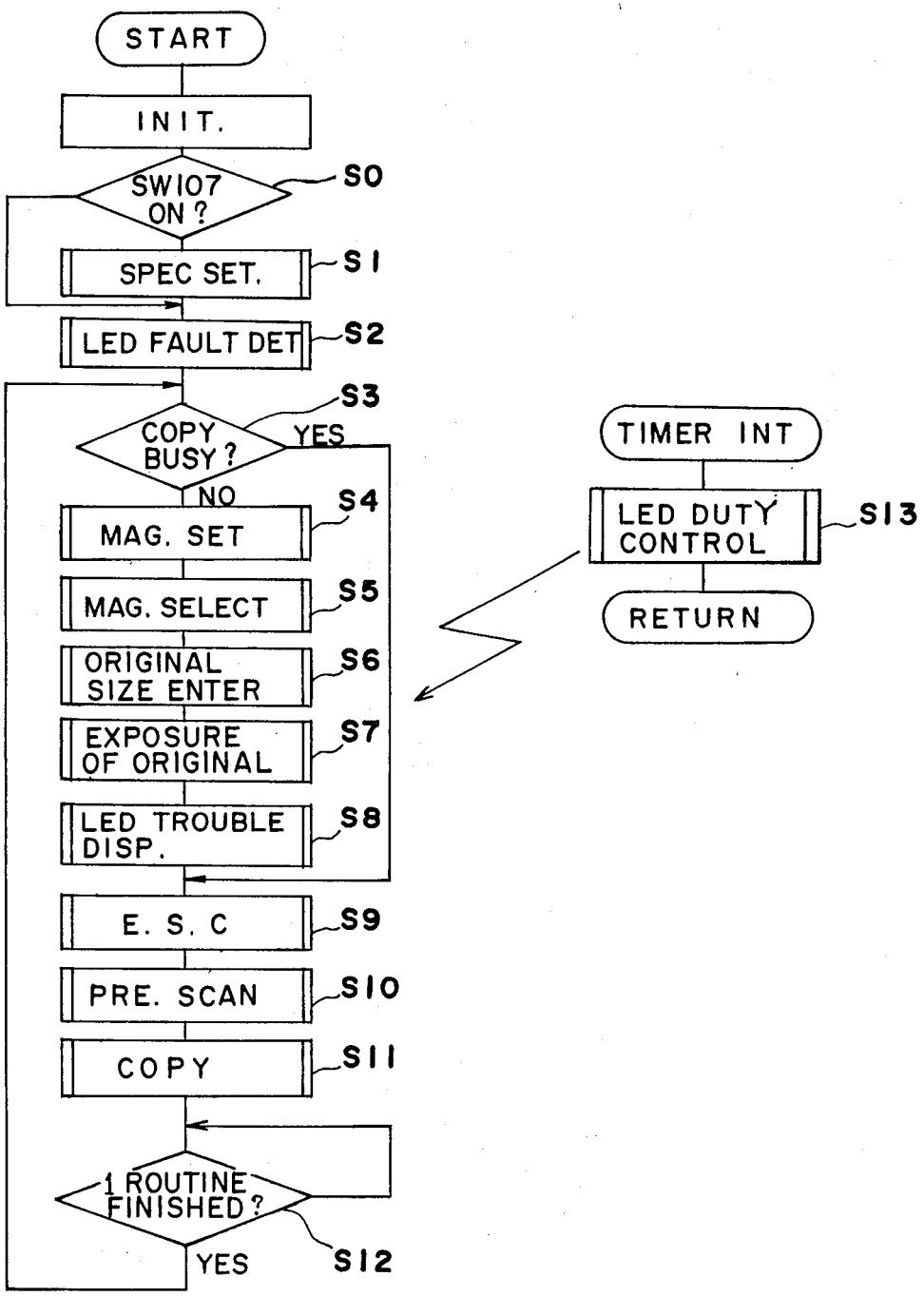
FIGS. 8 through 21 and 23 are flow chart showing operation of the copying machine according to the present invention.

FIG. 8 through FIGS. 21 and 23 shows the flow chart showing an operation performed by the CPU 201 for a copying operation. FIG. 8 generally shows the respective operation.

The first CPU 201 and the second CPU 202 communicates together by interruption. A scanning instruction of the optical system, scan size, copying magnification, timing signals, return signal and position signal etc. are communicated. The third and fourth CPUs 208 and 209 also communicate with the first CPU 201 by interruption.

Figure 9:
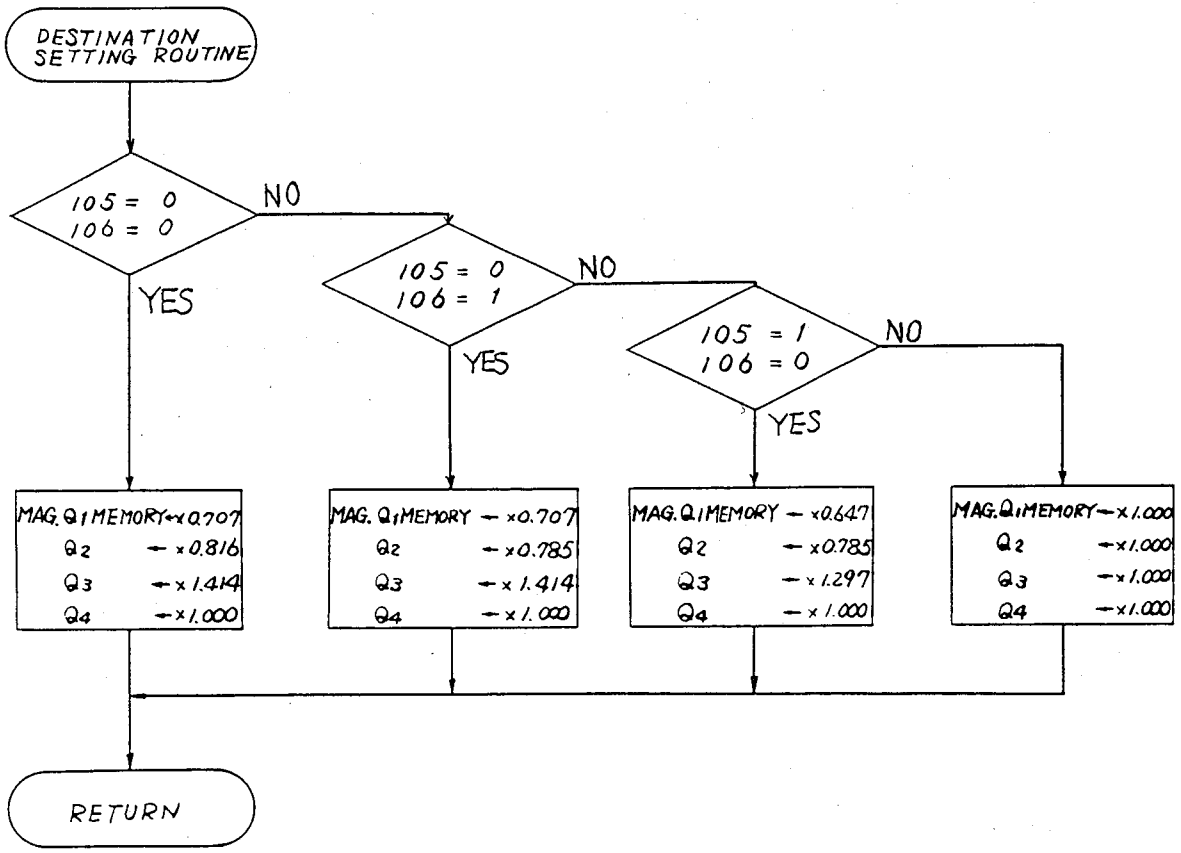

In FIG. 8, when it is detected that the switch 107 which is disposed in the left-hand in FIG. 1 of the copying apparatus is on in the step S0 after initialization, the process goes to a step S1, wherein copying magnification can be entered for storing various copying magnification values in the memories Q1 through Q4 in the manufacturing process of the copying machine particularly at the time of forwarding thereof. The detail of this operation is shown in FIG. 9.

Figure 10:
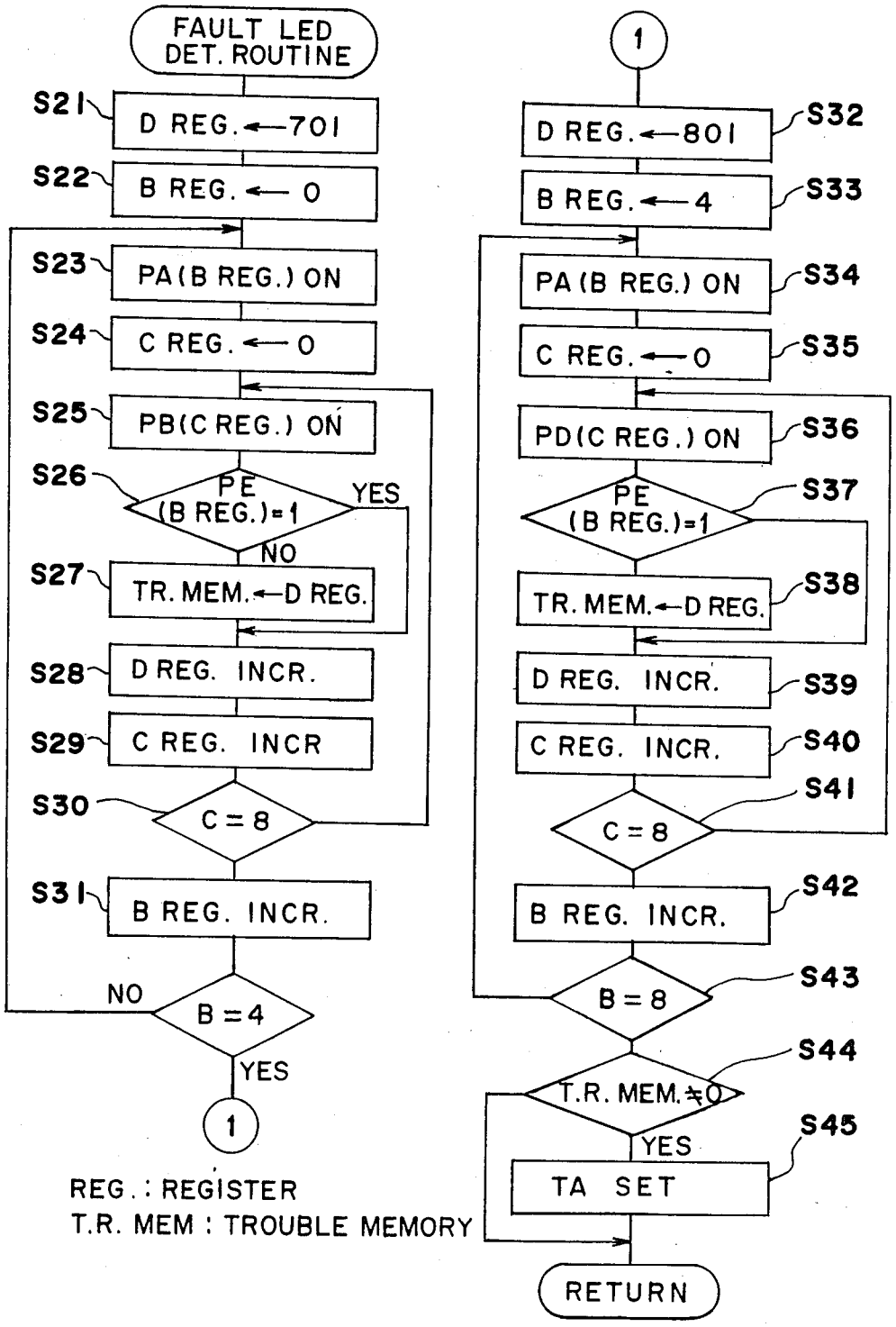

In a step S2, it is judged whether or not the respective LEDs 701 to 730 and 801 to 830 are operative. The detail of the operation is shown in FIG. 10.

In steps S3 and S4, when the copying machine is not busy, the respective keys 95 to 98 and 100 to 103 are assigned to the magnification values corresponding to the magnification values stored in the memories Q5 to Q8 and Q1 to Q4. The detail of the operation is shown in FIGS. 11 to 13.

In the step S5, various data for controlling the position of the lens of the optical system 10 and the speed of the motor for setting the magnification values and so on based on the data entered in the step S4 are transferred to the second CPU 202, which processes the entered data by interruption. The detail of this process is shown in FIGS. 14 and 15.

Figure 16:
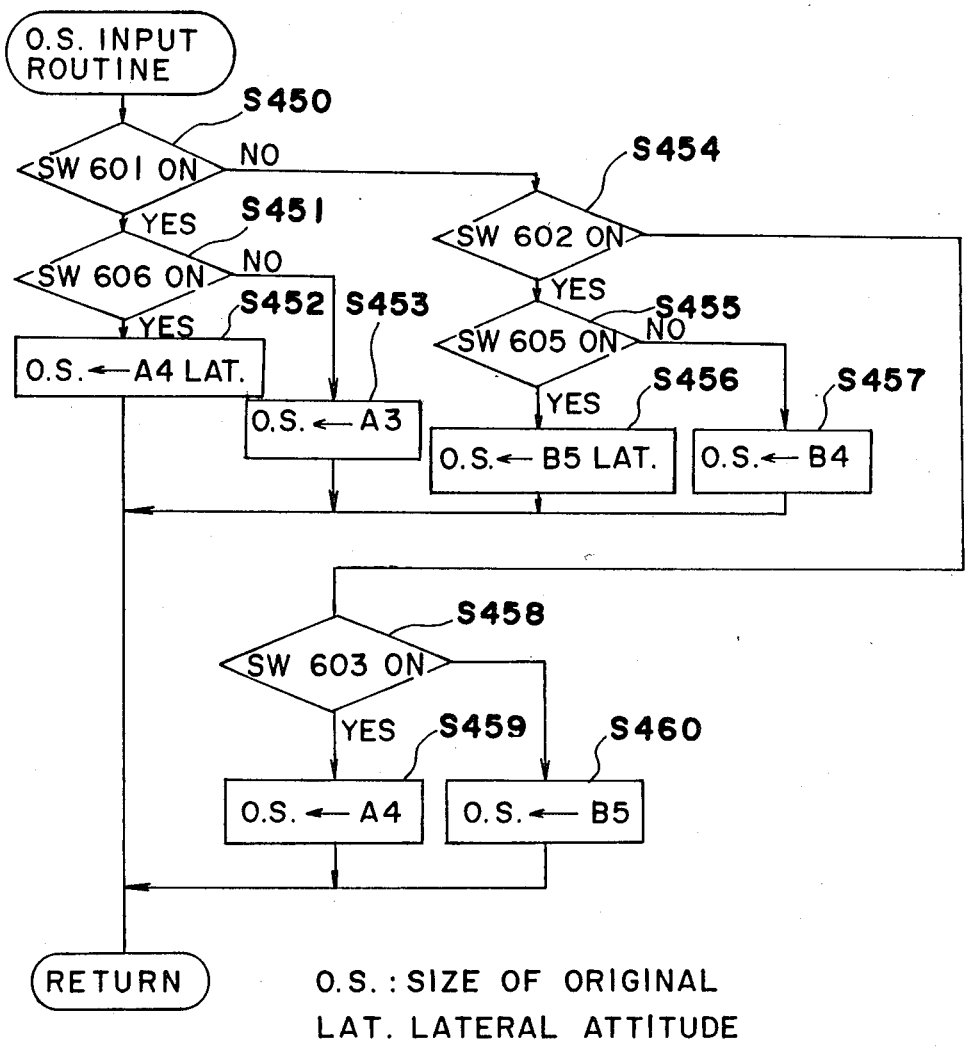
Figure 17A:
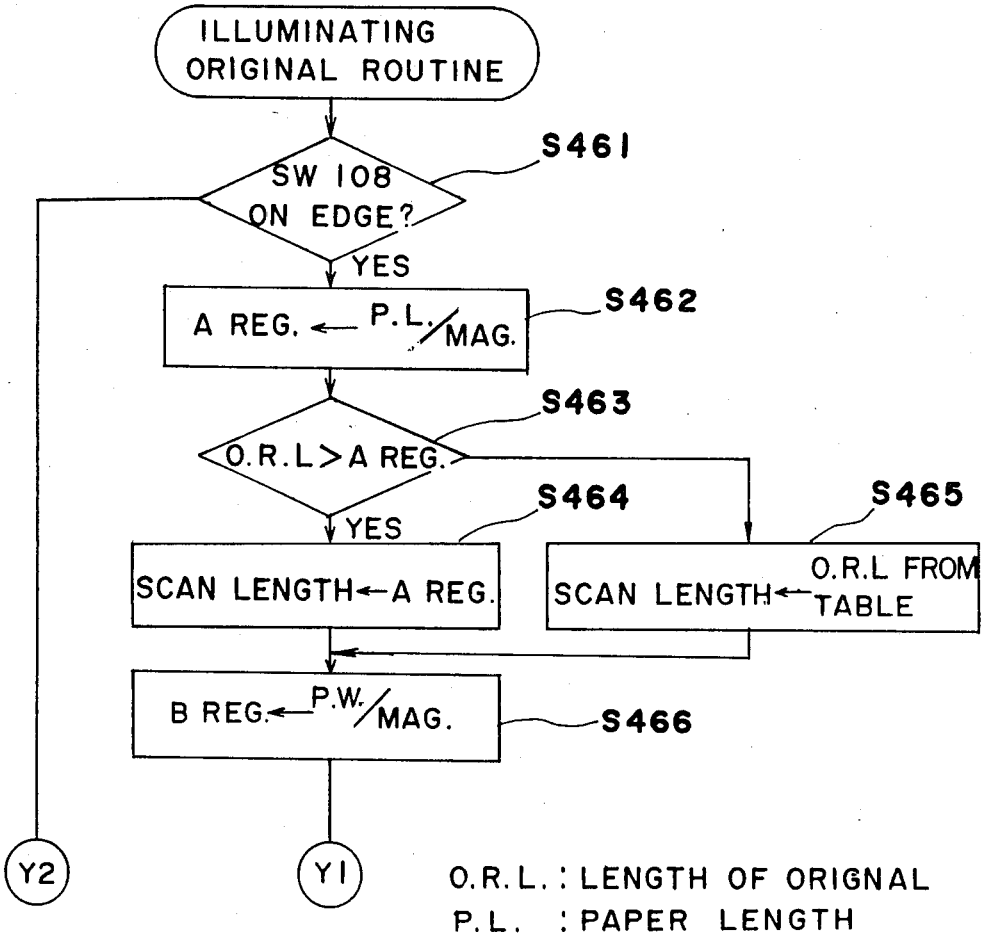
Figure 17B:
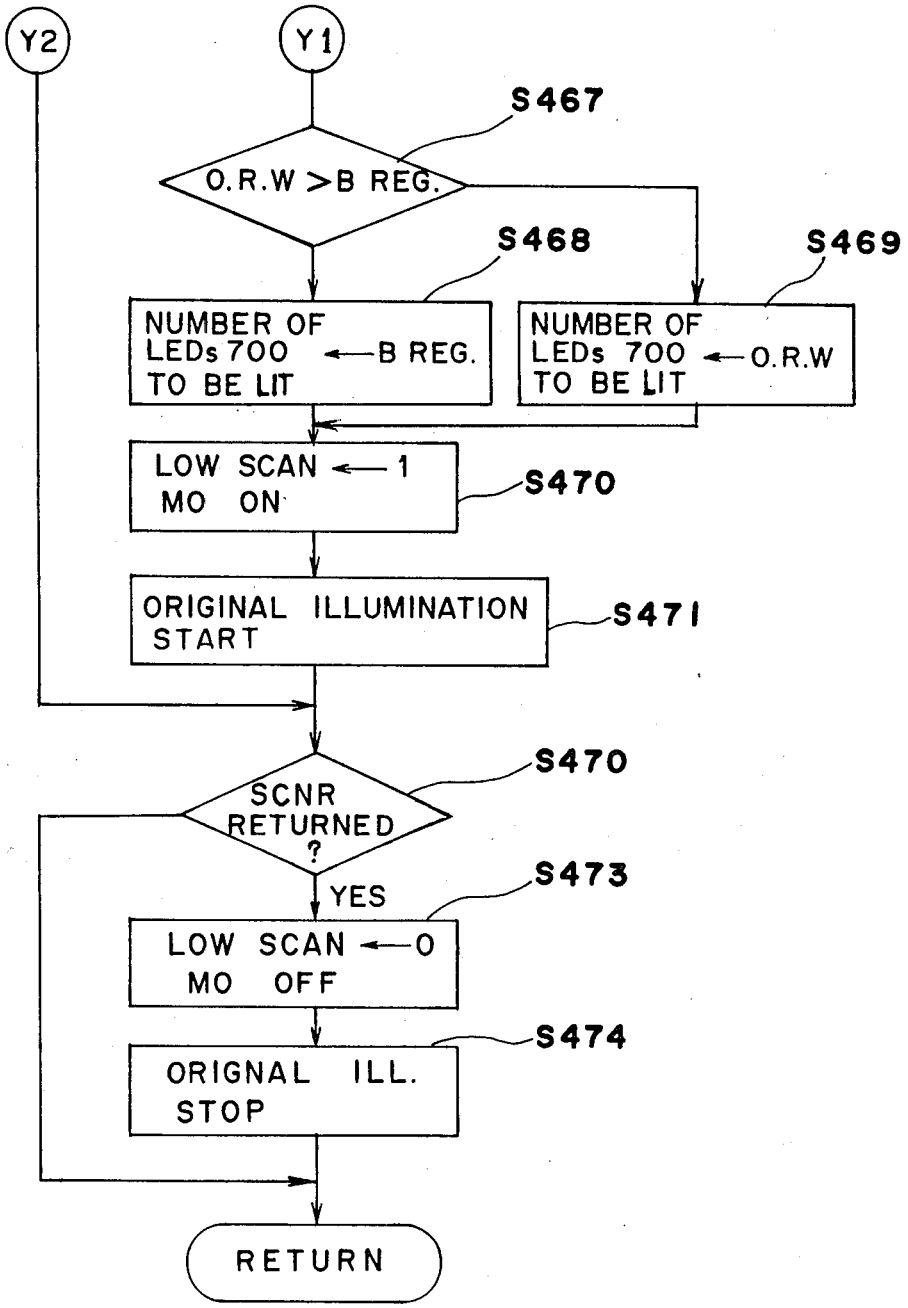
Figure 18A:
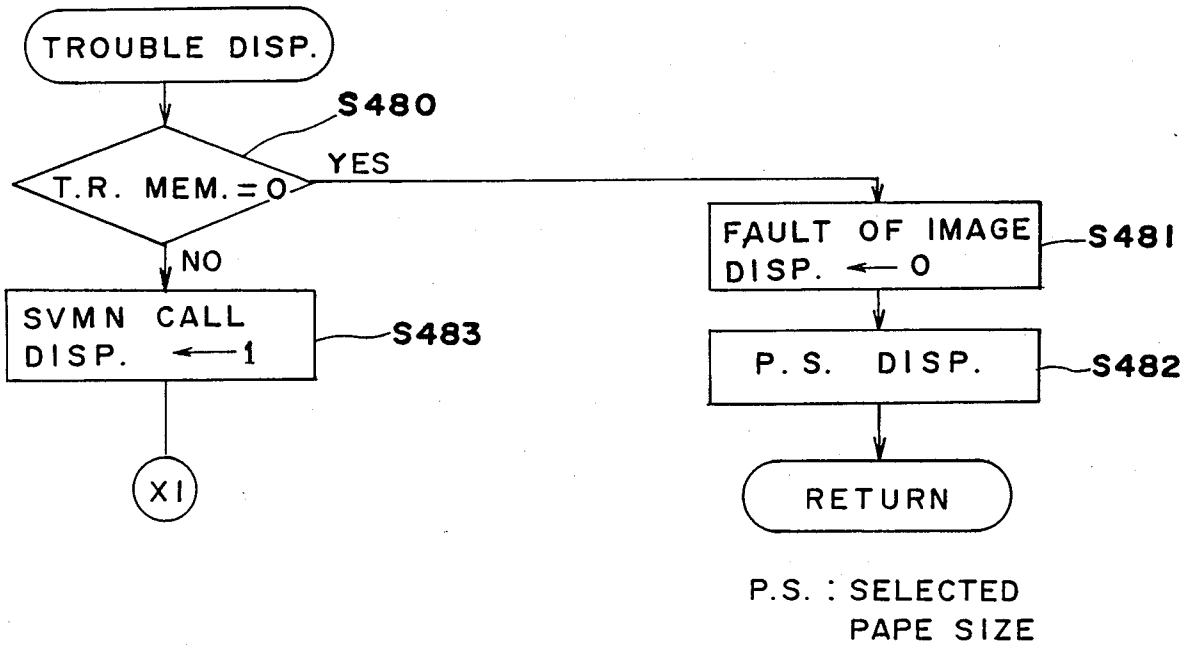
Figure 18B:
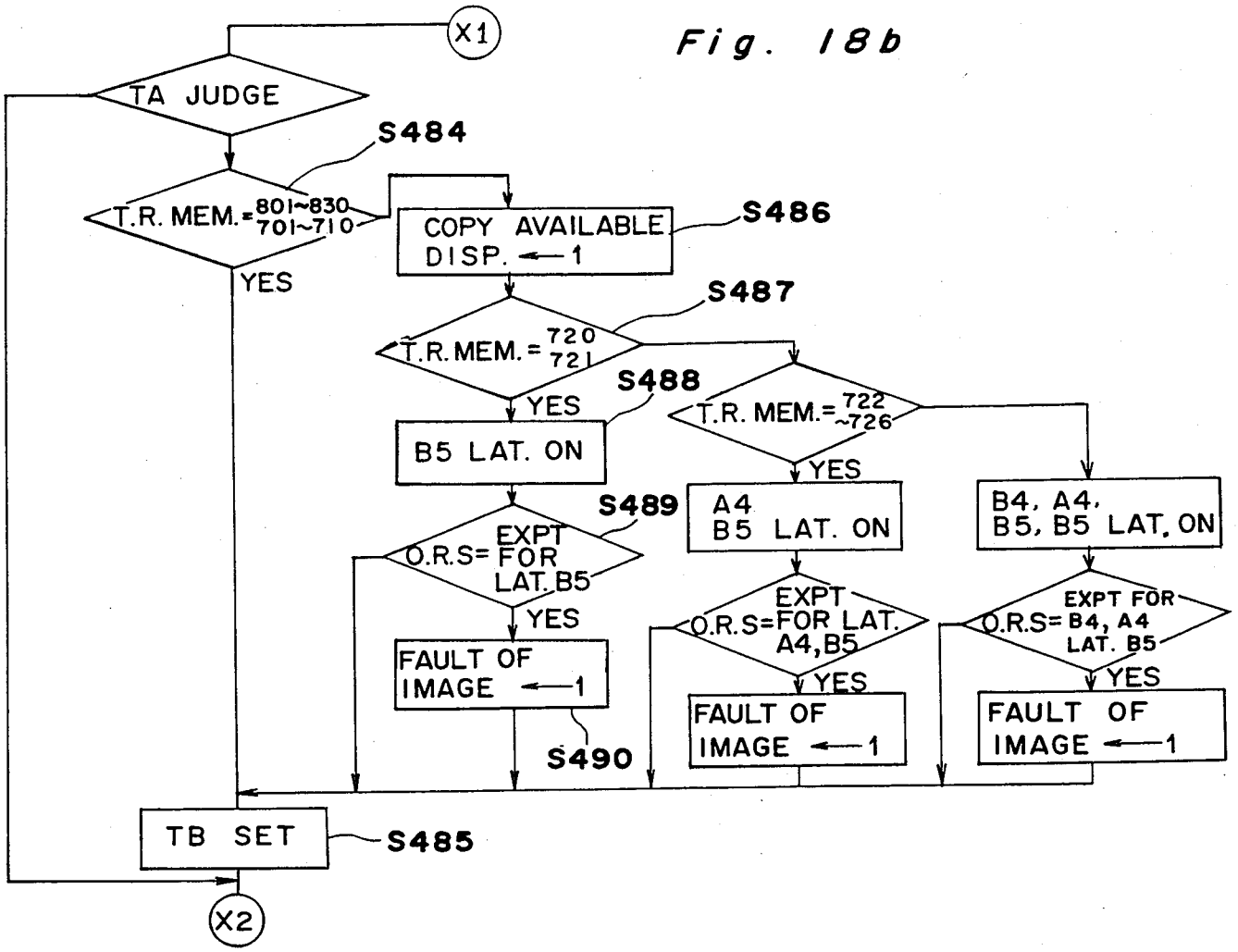
Figure 18C:
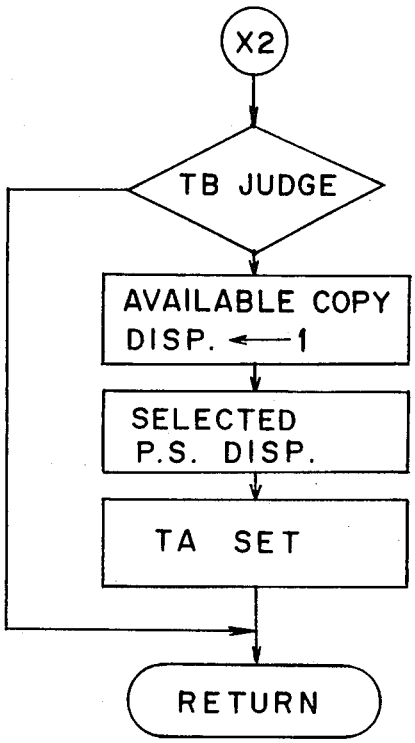
Figure 19:
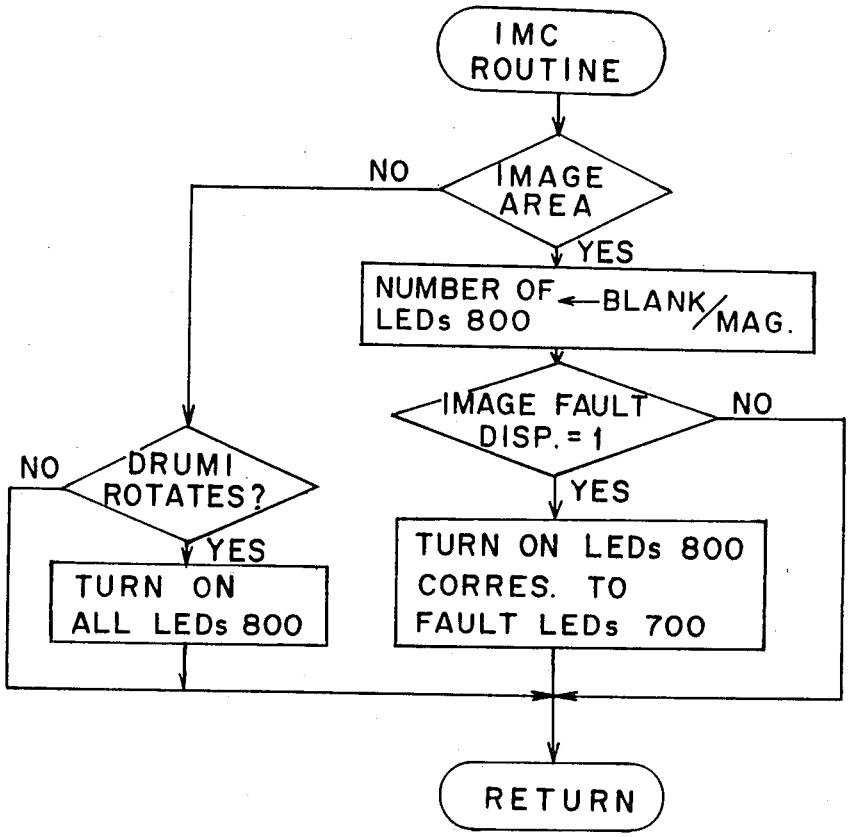
Figure 20A:
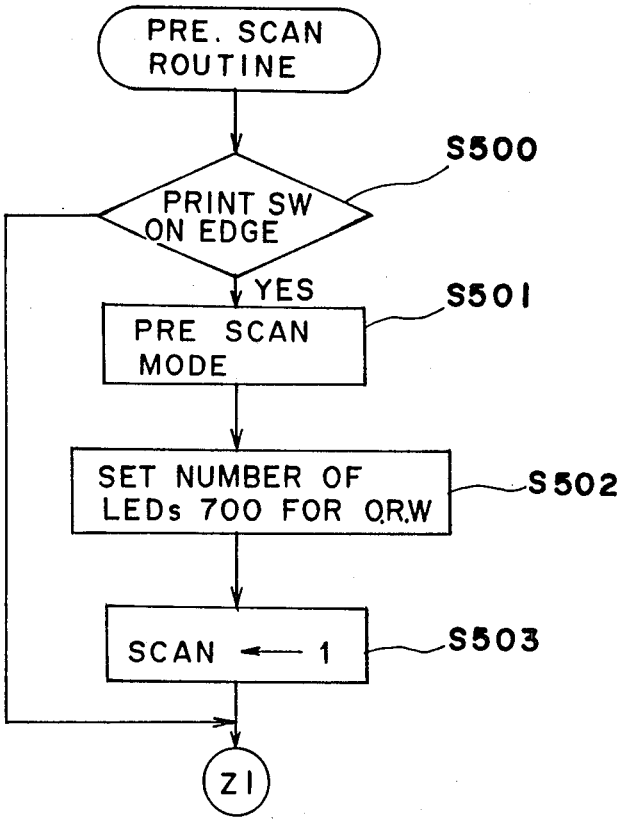
Figure 20B:
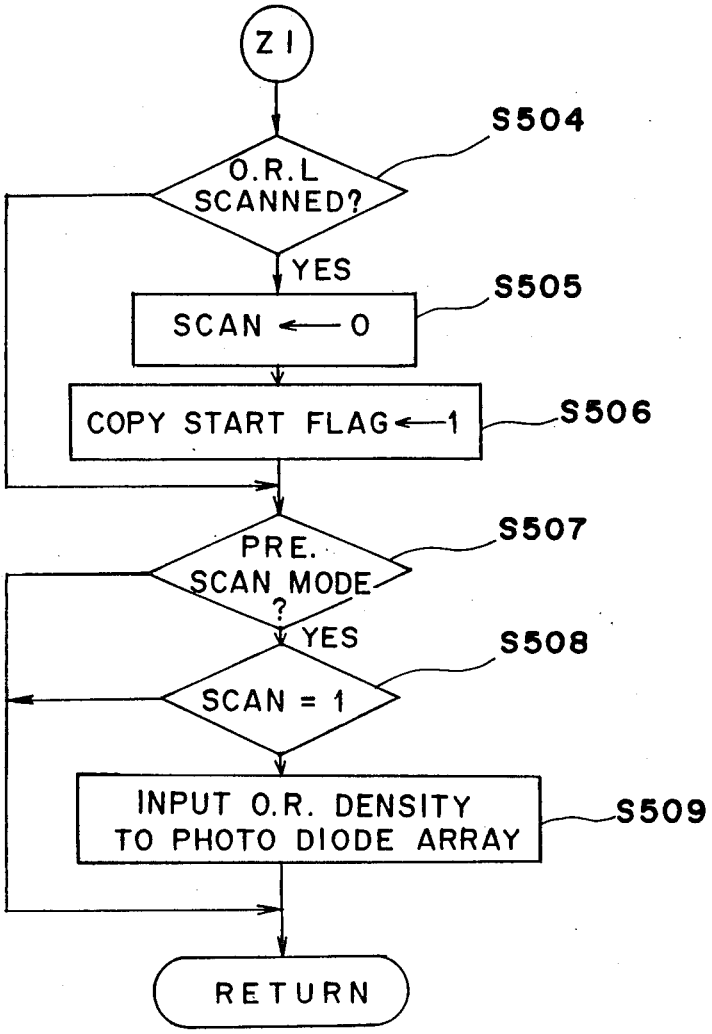
Figure 23:
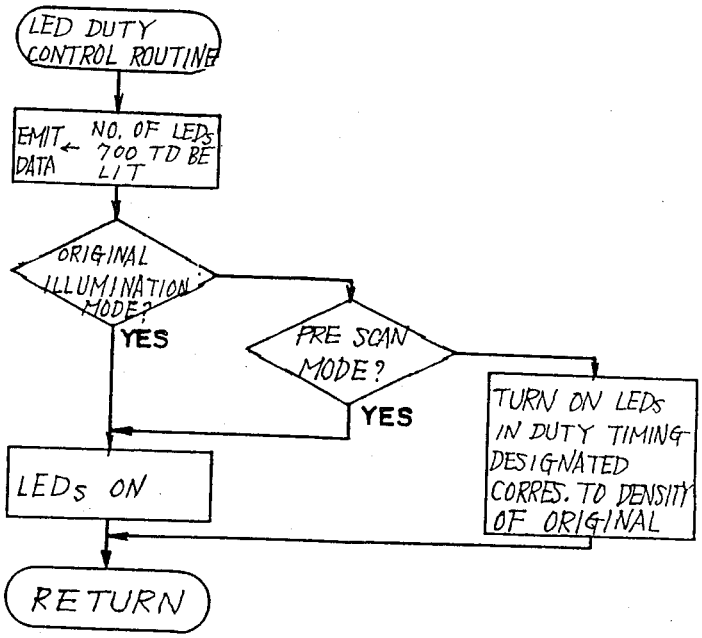

In the step S6, the size of the original to be copied can be entered, the detail of which is shown in FIG. 16. The step S7 is a routine for illumination of the original to be copied, the detail of which is shown in FIG. 17. The step S8 is a routine for display of the fault condition of the LEDs, the detail of which is shown in FIG. 18. The step S9 is a routine for erasing unnecessary image in the space between two adjacent images of the original or in the space of the edge parts of the photoreceptor drum 1, the detail of which is shown in FIG. 19. The step S10 is a preliminarily scanning routine, the detail of which is shown in FIG. 20. The step S11 is a copying routine, the detail of which is shown in FIG. 21. The step S12 judges whether or not the predetermined time period for one routine is expired. The step S13 is conducted by the timer interruption to the first CPU 201 and is a LED duty control routine for controlling the periods of light emission of the respective LEDs, the detail of which is shown in FIG. 23.

Said initialize switch 107 in the step S0 is provided in the interior of the copying machine so that only an engineer in the manufacturing process or service man can access the switch. When this switch 107 is operated, the operation routine shown in FIG. 9 is executed.

FIG. 9, shows for presetting the various copying magnification value in the memories Q1 to Q4 corresponding to the keys 100 to 103. The copying magnification values preset in the memories Q1 to Q4 can be determined by on state or off state of the switches 105 and 106 which are disposed beside the switch 107. Specifically, when the switches 105 or 106 are made on or off corresponding to the contents of the specification of the copying machine in the process of the production or at the time of fowarding of the copying machine, the magnification values can be selected by the combination of the on state and off state of the switches 105 and 106. Storing the copying magnification values in the memories Q1 through Q4 are executed after OFF operation of the initialize key 107. Table 2 shows an example of the magnification values corresponding to the states of the switches 105 and 106.

TABLE 2

| switch | | magnification | | | |
|---|---|---|---|---|---|
| 105 | 106 | Q1 | Q2 | Q3 | Q4 |
| 0 | 0 | 0.707 | 0.816 | 1.414 | 1.000 |
| 0 | 1 | 0.707 | 0.785 | 1.414 | 1.000 |
| 1 | 0 | 0.647 | 0.785 | 1.297 | 1.000 |
| 1 | 1 | 1.000 | 1.000 | 1.000 | 1.000 |

Referring to FIG. 10 showing the process of finding the fault condition of the LEDs, D register stores the serial number indicating the respective LEDs for example, with the initial value of the D register. The serial number 701 is set and the serial number is increased from 701 to 730 as the D register is operated.

B register stores the serial number of the the LED groups. In the preferred embodiment the LEDs 701 to 730 and 801 to 830 are grouped so that each group consists of eight LEDs, and the fault of LEDs is detected in the group basis with eight LEDs dealt as one unit. The content of the B register represent the serial number of the groups. C register stores the serial number of the LEDs in each group.

In the process of the flow chart of FIG. 10, steps S21 to S31 serve to detect the fault of the LEDs 701 to 730 and steps S32 to S43 serve to detect the fault of the LEDs 801 to 830.

In this process, detection of the fault of the LEDs 701 to 708 is made first. In the step S21, a value 701 representing the LED 701 is entered in the D register. Also in the step S12, 0 is entered in the B register as the initial value. In the step S23, pulses are generated at the terminal PA0 of the control device 208 so as to illuminate the LEDs 701 to 708. What terminals of PA0 to PA7 generates the pulse depend on the content of the B register. Subsequently, the content of the C register is set to 0. In the step S25, the terminals PB1 to PB7 generate pulse signal sequentially and the content of the photo coupler PHB1 is input to the terminal PE0, so that it is judged in the step S26 whether the terminal PE0 is 1 or 0 for detecting whether or not each of the LEDs 701 to 708 is in the fault condition. In case of the presence of the fault in the LEDs, the content of the D register is transferred to a trouble memory so as to store the serial number of the fault LED. The same operations of the steps S23 to S31 are repeated so as to examine the respective LEDs 709 to 716, 717 to 724 725 to 730. When the content of the B register becomes 4 the process advances to the step S32 for examining the LEDs 801 to 830 repeating the same operations as described above to find the fault of the light emitting diodes.

In the step S44, the trouble memory is examined and when a numeral except for 0 is stored, it is judged that there is a fault in LEDs and a timer TA is set in the step S44. The timer TA is used for displaying the available size of the original for copy and the selected paper size alternately in cooperation with a timer TB described in the explanation of FIG. 8.

Referring to FIGS. 11 to 13, for setting the copying magnification in the memory locations Q1 to Q8 for the keys 100 to 103 and 95 to 98, at steps S101 and S102 in FIG. 11, a determination is made as to which group of keys setting of magnification is required when the switch 99 or 104 is operated to switch the control mode to the copying magnification setting mode. When the control mode is switched to the first copying magnification setting mode upon operation of the key 99, a value "1" is set in a flag A. On the other hand, when the key 104 is operated, the value "1" is set in a flag B showing the second copying magnification setting mode.

When either the key 99 or 104 is thus operated, a process is effected for making the thousands digit flag "1" at the step S103 while making the units digit display "0" at the step S105. That is, when the control mode of the copying apparatus is switched to either magnification setting mode, a display "bbb0" (b indicates a blank) is shown on the display device 72, and the copying apparatus is in a stand-by condition for receiving an input from the thousands digit column.

When the ten keys 80 to 89 are operated in the aforementioned condition, which of the keys 80 to 89 is operated is determined at a step S107, and the process is advanced to a step S108 only when a "1" key 80 is selected to indicate that the thousands digit flag is "1". The input values are expressed herein as the thousands digit, the hundreds digit, the tens digit and the units digit in consideration of the relation with the numerical value display device 72, though, it is to be noted that values indicating the copying magnifications are processed as decimal numbers ranging from down to three decimal places up to an effective number of four figures with three decimal places.

In a case where the thousands digit flag is "1" and the input value is 0 or one of 2 through 9, the process is advanced to a step S110 for displaying "0" as the thousands digit. Then, if the input is "0", the process is advanced to a step S109 as in the case of "1" to make the thousands digit flag "0" while making the hundreds digit flag "1" for standing by an input to the hundreds digit column. On the other hand, when the input is one of 2 through 9, the thousands digit display is made "0" at a step S112 and then the process is advanced to a step S115 to display the input value as the hundreds digit.

The aforementioned process, effected when the thousands digit flag is "1", is based on the premise that values within the range of 0.647 to 1.414 are considered effective as the copying magnification values. Consequently, only "1" or "0" can be displayed as the thousands digit. By virtue of this, operation for inputting "0" as the thousands digit may be simplified. However, it is to be noted that, even in the aforementioned process, the copying magnification value might deviate from the aforementioned range depending on the values input below the hundreds digit. Such a case is hereinafter described with reference to a sub routine shown in FIGS. 11*a* through 11*c* and FIG. 12.

The hundreds digit flag is made "1" upon input of a value to the thousands digit column, and when one of the ten key 80 to 89 is operated under this condition, a value corresponding to the operated key 80 to 89 is input in the hundreds digit column so that said value is displayed at a step S115 and a process is effected at a step S116 to make the hundreds digit flag "0" while making the tens digit flag "1". Input of values to the tens digit and units digit columns is effected in a similar manner by operation of the ten keys 80 to 89.

Figure 11A:
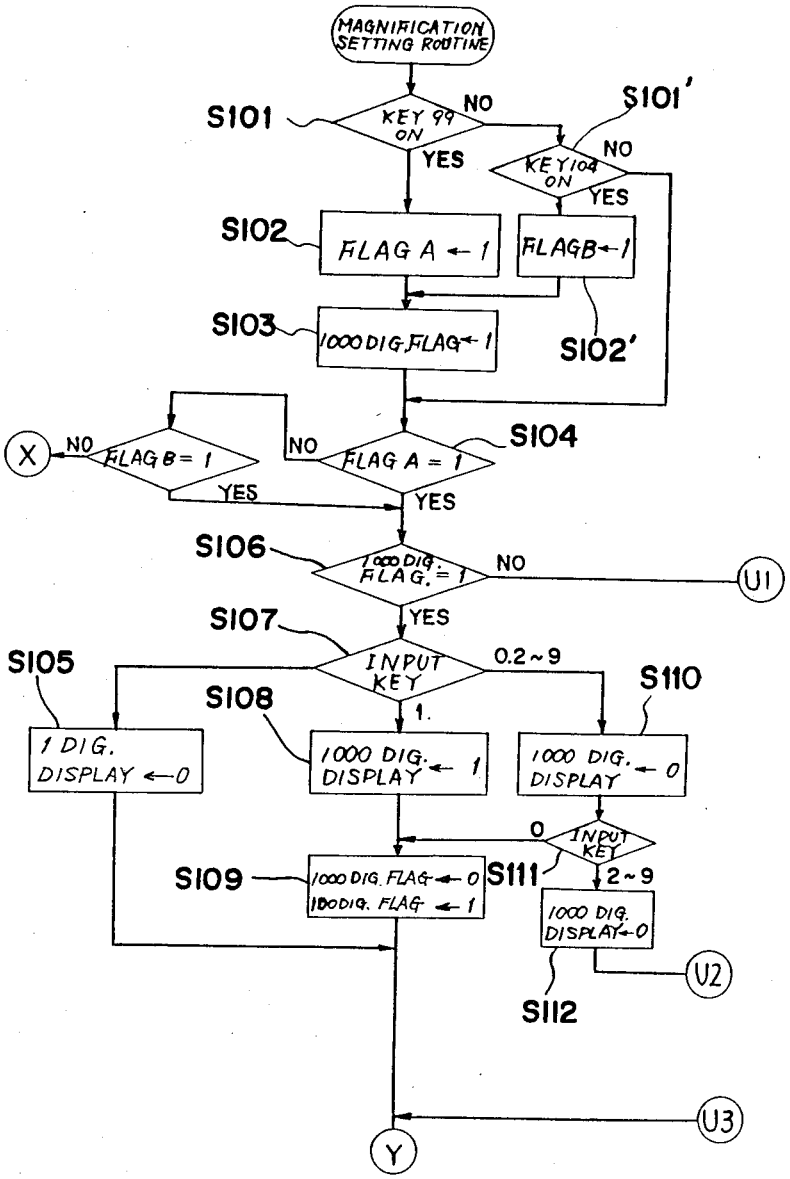
Figure 11B:
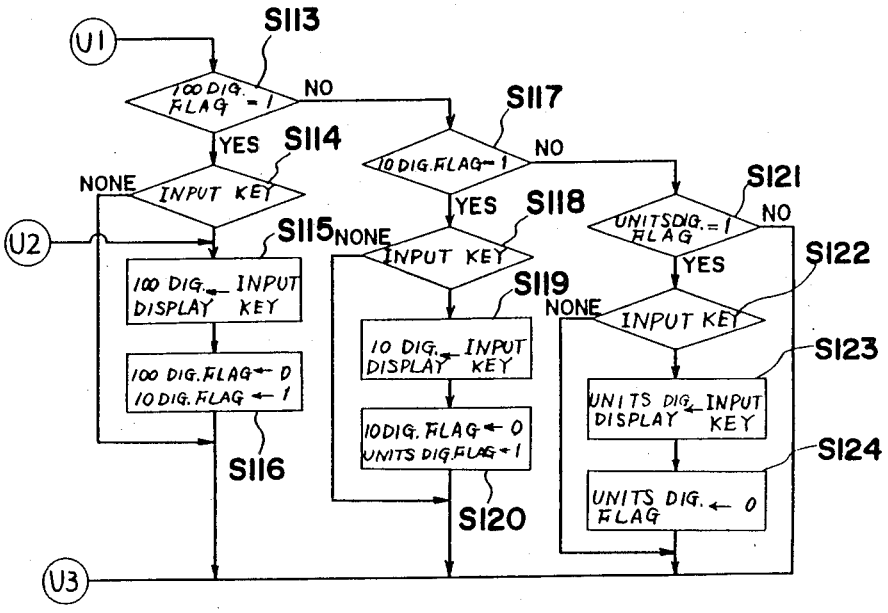
Figure 12A:
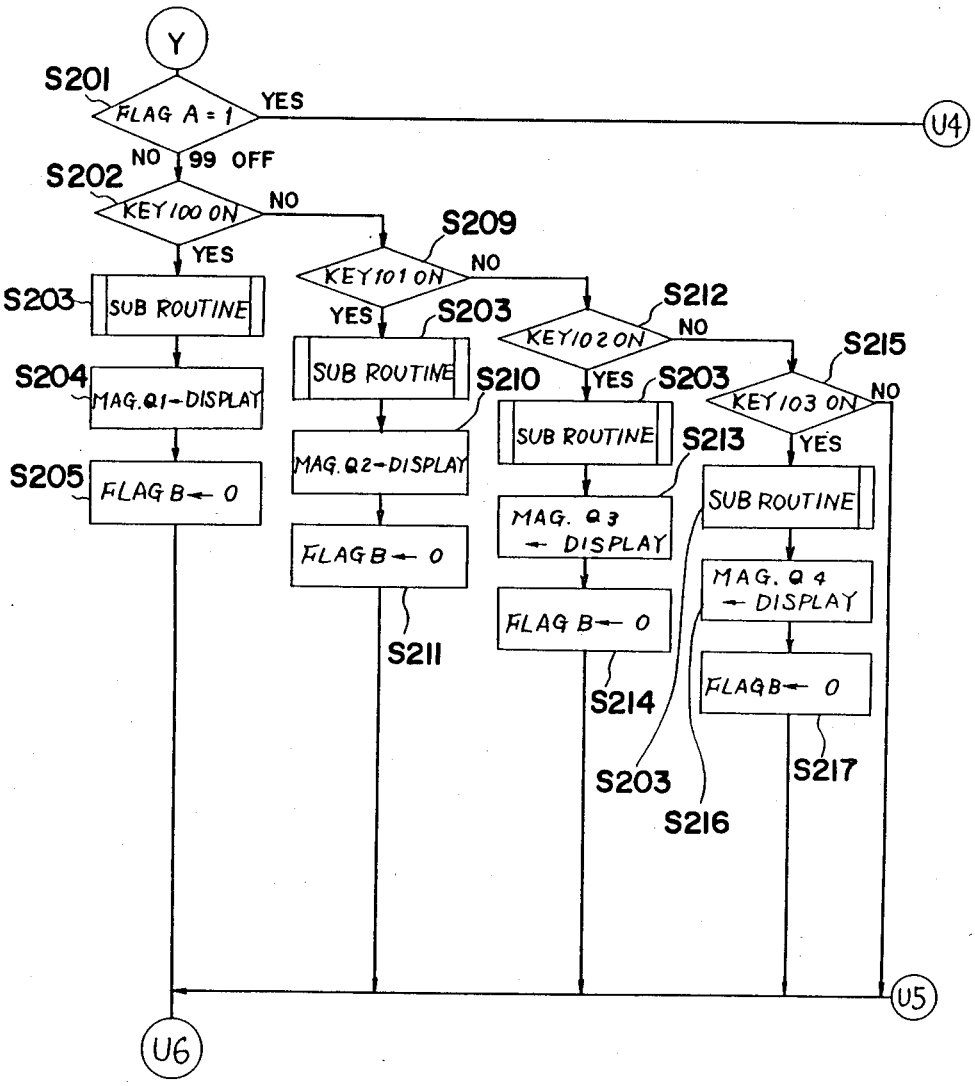
Figure 12B:
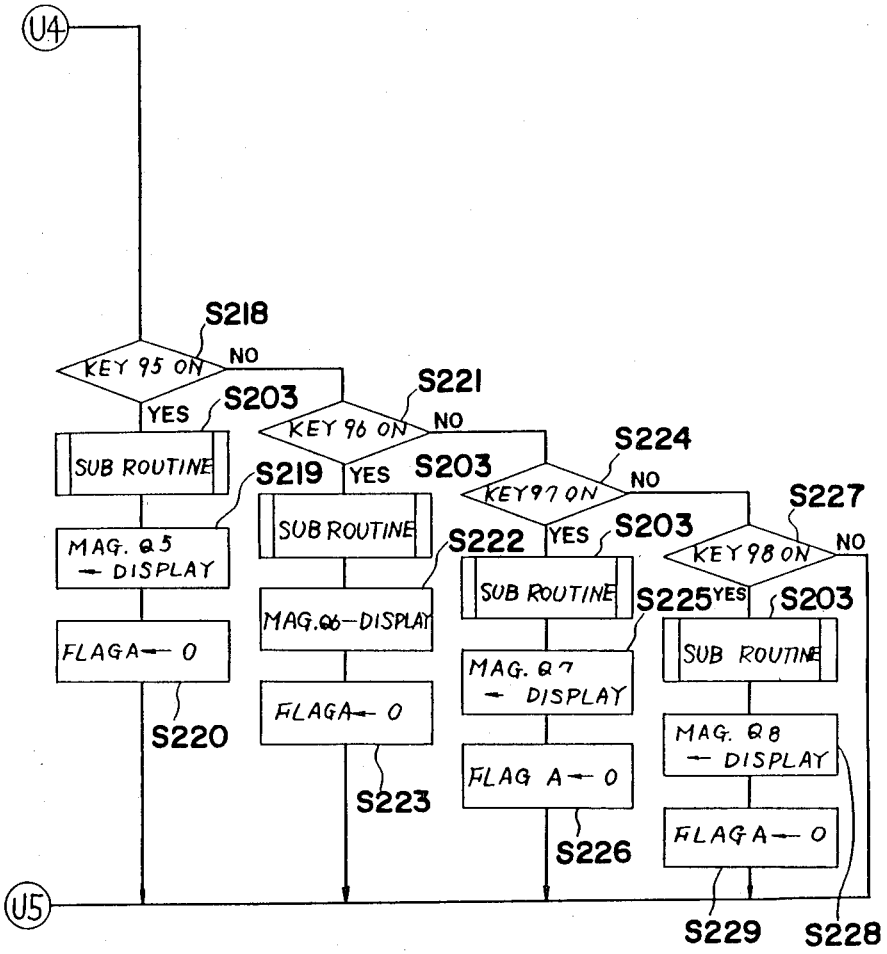
Figure 12C:
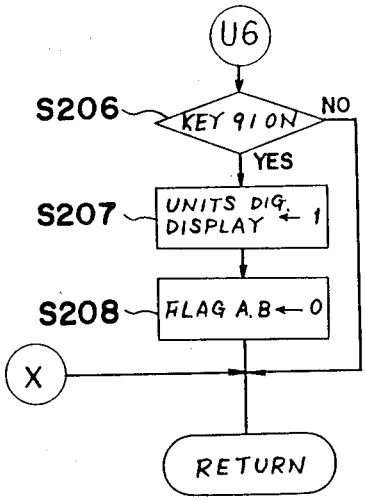
Figure 13:
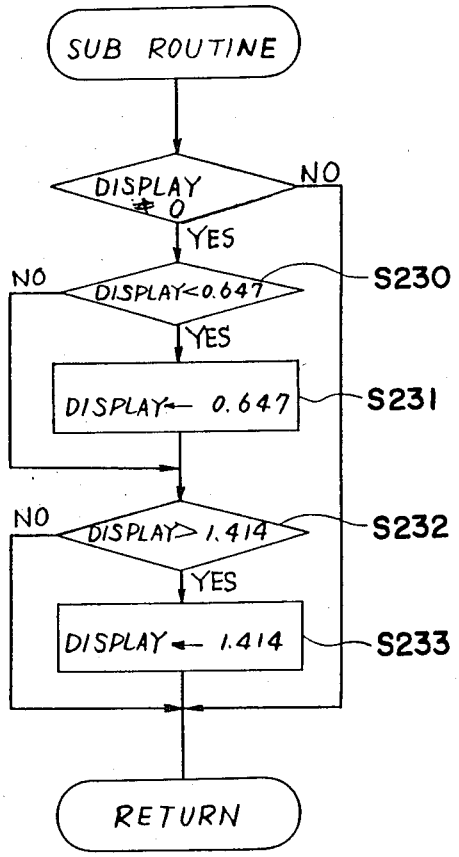

FIGS. 12*a* through 12*c* show a flow chart showing a process of storing the value input and displayed by the process of FIGS. 11*a* and 11*b* in a memory location corresponding to the selection key 95 to 98, 100 to 103 operated in the subsequent stage.

At a step S201, a determination is made as to whether the control mode is in the first magnification setting mode or in the second magnification setting mode. Since the process of the step S201 is effected only when either the flags A or B is at "1", determination at the step S201 is carried out as to only whether or not, e.g., the flag A is "1". When the flag A is "1", the control mode is in the first magnification setting mode and the process is advanced to a step S218 for determination based upon operations of the first group of keys 95 through 98. When the flag A is not "1", i.e., when the flag B is "1", the control mode is in the second magnification setting mode and the process is advanced to a step S202 for determination based upon operations of the second group of keys 100 through 103.

In each of the steps as shown in FIGS. 12*a* through 12*c*, a basic process is effected in which a displayed value is stored in a memory location corresponding to the operated selection key 95 to 98, 100 to 103. However, in such a stage, a value deviating from an allowable range of the copying magnification might be displayed as hereinabove described. Therefore, in the process of FIGS. 12*a* through 12*c*, a sub routine indicated by a step S203 is effected following determination of the operation of each key 95 to 98, 100 to 103 so that the deviating value is not stored in the RAM memory. FIG. 13 shows the process effected at the step S203.

When the displayed value is not "0" in FIG. 13, a determination is made as to whether or not the displayed value is smaller than 0.647, and if the determination is "Yes", the value 0.647 is displayed at a step S231. Further determination is made at a step S232 as to whether or not the displayed value is larger than 1.414, and if the determination is "Yes", the value 1.414 is displayed at a step S233.

Thus, with reference to FIGS. 12*a* through 12*c*, when a predetermined selection key is operated in a magnification setting mode and a displayed value is out of the allowable range, the display is considered an allowable limit value, and thereafter the displayed value is stored in a memory corresponding to the selection key. Upon effecting of the process for storing the value in the memory, the flag A is made "0" in case of the first magnification setting mode while the flag B is made "0" in case of the second magnification setting mode, and the process is advanced to a step S206.

Steps S206 through S208 relate to processes effected upon operation of the clear stop key 91 (FIG. 5). When the clear stop key 91 is operated, "bbb1" is displayed in the display device 72 at the steps S207 and S208 while the flags A and B are made "0". That is, upon operation of the clear stop key 91, the value that has been displayed is cleared and the magnification setting mode is released. Therefore, the value "1" displayed in this process is indicative of a reference value of the copy number.

In FIGS. 14*a* through 15*b*, there are shown processes effected upon operation of the second group of selection keys 100 through 103 and the first group of selection keys 95 through 98 respectively.

Figure 14A:
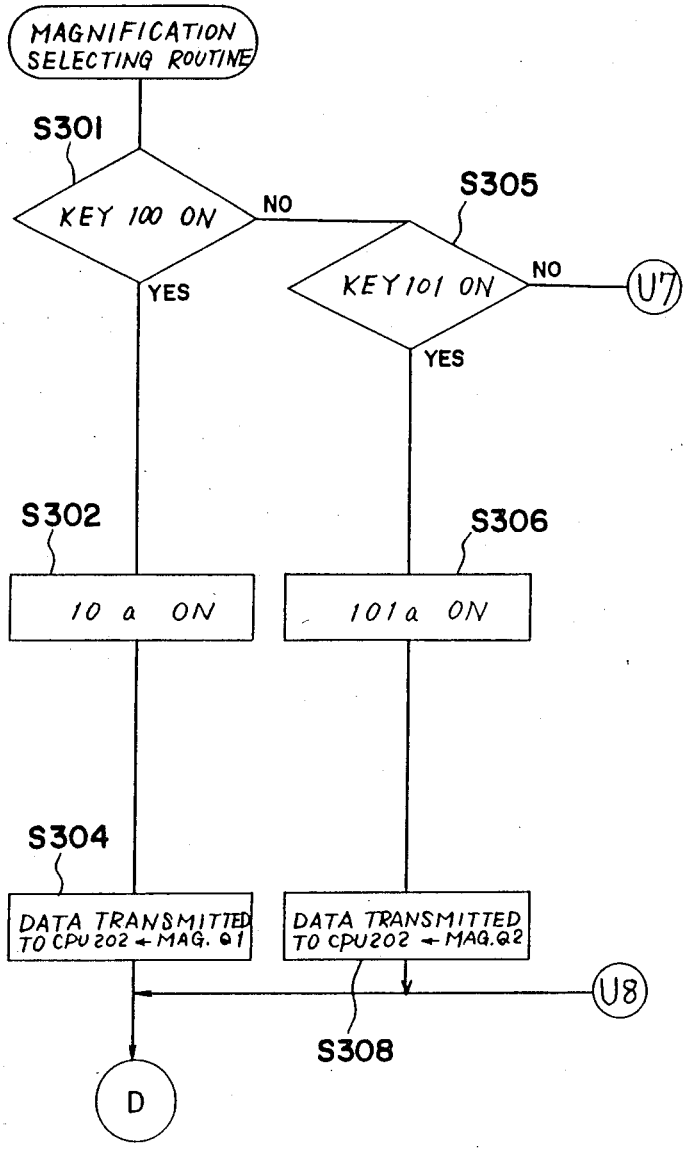
Figure 14B:
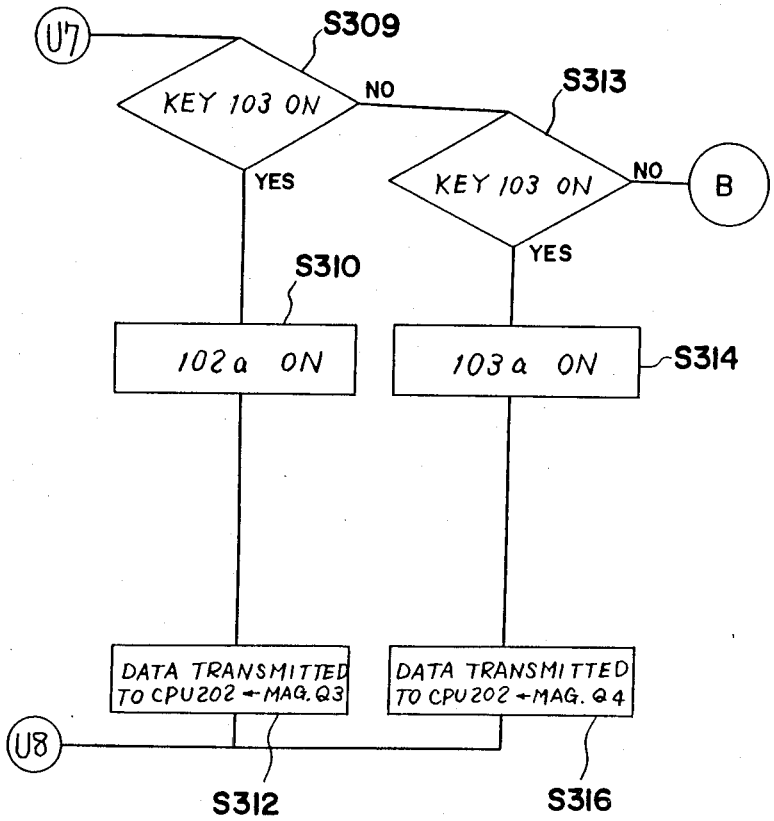
Figure 15A:
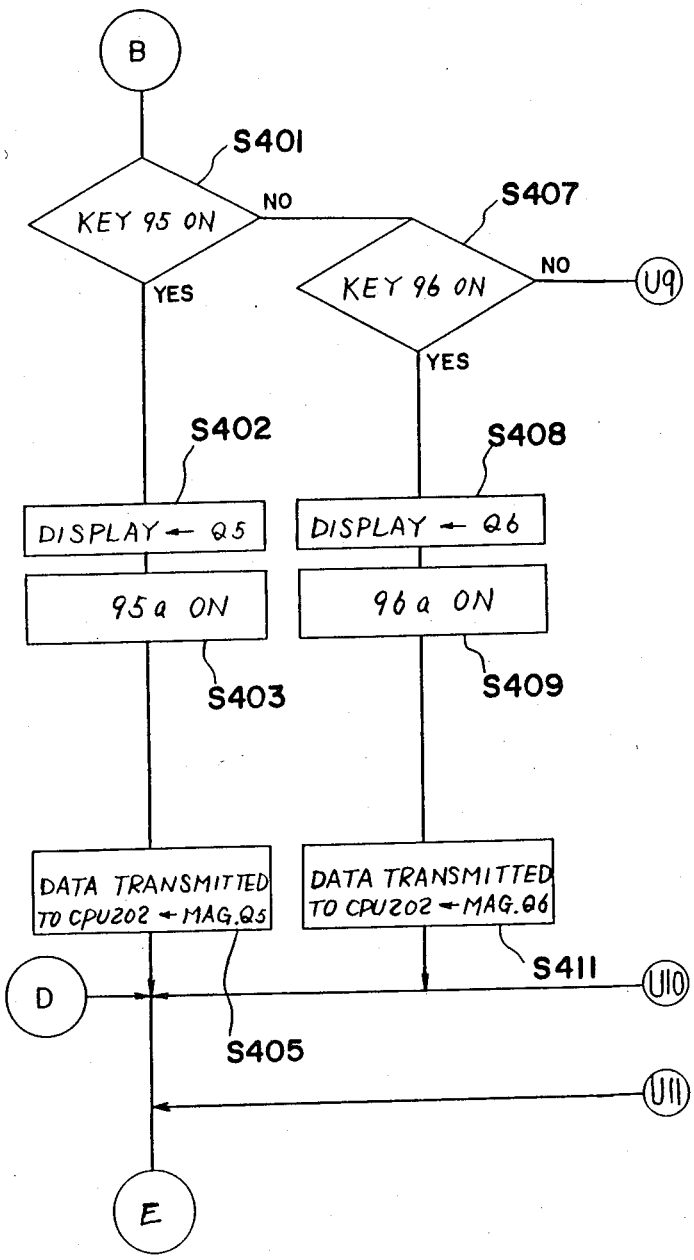
Figure 15B:
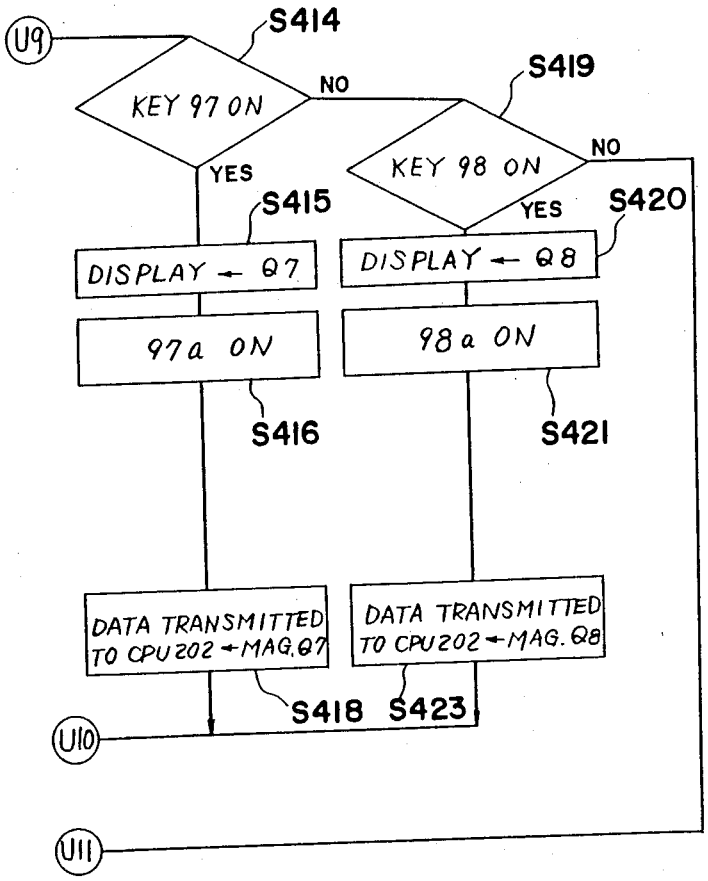

When one of the keys 100, 101, 102 and 103 is operated in FIGS. 14*a* and 14*b*, one of light emission diodes 100*a*, 101*a*, 102*a* and 103*a* (FIG. 6) provided respectively in correspondence to the keys 100 to 103 is turned on so that the value stored in the corresponding memory location is transferred as the magnification data to the second CPU 202, and the process is advanced to a step S406 in FIGS. 15*a* and 15*b*.

When one of the selection keys 95 through 98 is operated in FIGS. 15*a* and 15*b*, the corresponding light emitted diode 95*a* to 98*a* is turned on while the values set in the memory locations Q5 through Q8 corresponding to the key is displayed in the display device 72 at steps S402, S408, S415 and S420 since the magnification can be selectively set in this condition. Such a display is effected only when, e.g., each of the respective keys 95 to 98 is depressed, and upon releasing of the key 95 to 98, a selected magnification ratio stored in the other memory device is accessed to be displayed in the display device 72.

FIG. 16 shows the original size input routine. In this routine, the size of the original can be detected by the combination of the states of the switches 601 to 606. The detected original size is stored in the memory. For example, in the steps S450 and S451 if it is detected that the switches 601 and 606 are on, it can be noticed that the size of the original is A4 with the lateral attitude. The way of other sizes and the attitudes of the original placed on the platform 16 can be understood by the description of FIG. 16.

FIG. 17 shows the original illuminating routine. In this routine, LED array 700 is turned on with the full light emission. Then the size of the original is compared with an effective image area which is decided by the paper size and the copying magnification value and the smaller one is adopted for illuminating any of the LEDs 801 to 830 for illuminating the original. The original is scanned by the optical system 10 with the slow speed so that the operator of the copying machine can notice the area of the original to be actually copied by seeing the light passing through the original.

When the switch 108 is turned on, an edge of the signal of the switch 108 is detected in the step S461 and the process advances to the step S462 to calculate the following equation.

$$\text{paper length/copying magnification} \quad (1)$$

The value of the equation (1) is stored in a A register. The paper length can be obtained by the table 3 stored in the memory.

TABLE 3

| size | length (mm) | width (mm) |
|---|---|---|
| A3 | 420 | 297 |
| B4 | 364 | 257 |
| A4 | 297 | 210 |
| B5 | 257 | 182 |
| A4 lateral | 210 | 297 |
| B5 lateral | 182 | 257 |

In the step S463, the paper length obtained from the table 3 is compared with the content of an A register i.e., the divided value of the equation (1), then if the paper length is larger than said divided value, the process advances to the step S464. With the paper length to be smaller than said divided value, the process advances to the step S465. By this operation, the smaller value obtained in the manner as described above is stored in the memory as the scan length of the scanner and the stored value is transferred to the CPU 202.

In the step S466, the paper width obtained by the table 3 is compared with another divided value of $$\text{(paper width)/(copying magnification)} \quad (2)$$

and a comparison between the paper width and the another divided value of the equation (2) and the smaller one is stored in the memory as the number of the LEDs of the LED array 700 to be turned on and the main motor is driven.

A low speed scan signal is transferred to the second CPU 202 in the step S470.

And then the required number of LEDs 701 to 730 is turned on in the step S471 for illuminating the original.

The illumination to the original can be made by turning on the required number of LEDs stored in the memory in the steps S468 or S469. The scan length of the scanner can be controlled by the scan length data set in the step S464 or S465.

When the scanner returns to the home position, the low speed scan signal is made 0, so as to stop the main motor with the LED array 700 turned off in the steps S472 to S474.

By this low speed scanning of the original, displacement of the original relative to the required position on the platform 16 can be detected.

The work of detecting the displacement of the original may be performed in such a case that, for example, an operator wishes to make a copy of a part of an original of B4 size ( the said part original may be A4 size) on a copying paper of A4 size. In this case, the required number of the LEDs to be illuminated in the LED array 700 is coincided with the size of the width (210 mm) of A4 size and the scan length is coincided with the length (297 mm) of A4 size, so that by scanning the original with the said number of LEDs turned on, the area of the original which is illuminated by the LEDs corresponds to A4 size. Thus it can be recognized whether the required part of the original is coincided with the available copy area (in this case the area of A4 size) by seeing the light pattern passed the original.

Referring to FIG. 18 showing the trouble display routine, if the content of the trouble memory is 0, which means that fault of the LED array 700 is not present, the process advances to the step S481 wherein an image fault display unit 111 for displaying the presence of possibility of the fault of the image on the copying paper is turned off and the process advances to the step S482 so as to cause the normal selected paper size to be display in the paper size display. If the content of the trouble memory is not 0, a serviceman call display 109 is turned on.

A process for displaying the available copy size and the selected paper size alternately by the timers TA and TB is described hereinafter.

When the time counted by the timer TA is lapsed, if the content of the trouble memory that is the serial number of the fault LED is any of 801 to 830 and/or 701 to 719, the copy is impossible and the display is kept unchanged in the steps S484 and S485. If there occur states other than the state mentioned above in the memory, the process moves to the step S486 to turn the copy available display 110 on.

If the content of the trouble memory is 720 or 721, since a copy of the original of B5 size with the lateral attitude is possible, B5 lateral attitude display is turned on. If the original size is other than B5 size with the lateral attitude, the image fault display 111 is turned on in the steps S489 and S490. In case of another content of the trouble memory, the process is conducted as shown in FIG. 18. Then the timer TB is set. When the time set in the timer TB is finished, the copy available display 110 is made off, and the selected paper size can be displayed in the paper size display 109 and the timer TA is set again. By repeating the routine mentioned above, the timers TA and TB are set alternately, the copy available size display with the copy available display and the selected size display without the copy available display are alternately displayed. Thus by seeing the display, the user is able to determine whether or not the selection of the paper should be made again.

FIG. 19 shows the routine for controlling the erasure of the image in the space between the two adjacent images of the original or in the space of the edge parts of the drum 1.

LED array 800 is used for this purpose. LED array 800 is entirely turned on during rotation of the photoreceptor drum 1 on which the image part of the original is not projected. While the necessary part of the original is illuminated, the value of (blank part of the original)/(copying magnification) is stored in the memory as the number of the LEDs to be illuminated.

When the image fault display is turned on, that is when the copy is made under the condition that one of the LEDs of the LED array 700 is in failure, there is formed a black strip in the potential image on the photoreceptor drum 1. In order to erase the black strip, the corresponding LED in the LED array 800 is illuminated.

FIG. 20 shows a preliminary scanning routine.

When it is detected that the print switch 71 is turned on in the step S500, a preliminary scanning is performed for memorizing the density of the image of the original. In the step S501 the operation mode of the copying machine is set to the preliminarily scanning mode and the signal representing the preliminary scanning mode is transferred to the second CPU 202. The number of the LEDs of the LED array 700 corresponding to the width of the original to be copied is stored in the memory in the step S502 for exposure of the width of the original to be copied. Since the width of the original is indicated by the knobs 650 and 651, it may be different from the actual original size. The scan signal is made 1 in the step S503 to start the scanning of the scanner.

Subsequently, when it is detected in the step S504 that the scanner finishes the necessary scan length, the scan signal is turned off and the copy start flag is made 1.

During execution of the preliminary scanning, the density of the original is detected by the photo diode array 900 and the detected density is stored in the respective areas corresponding to the respective LEDs of the LED array 900 (see the steps S507 to S509). The stored density is used for adjusting the light amount of each LEDs of the LED array 700.

Copying Operation

Figure 21A:
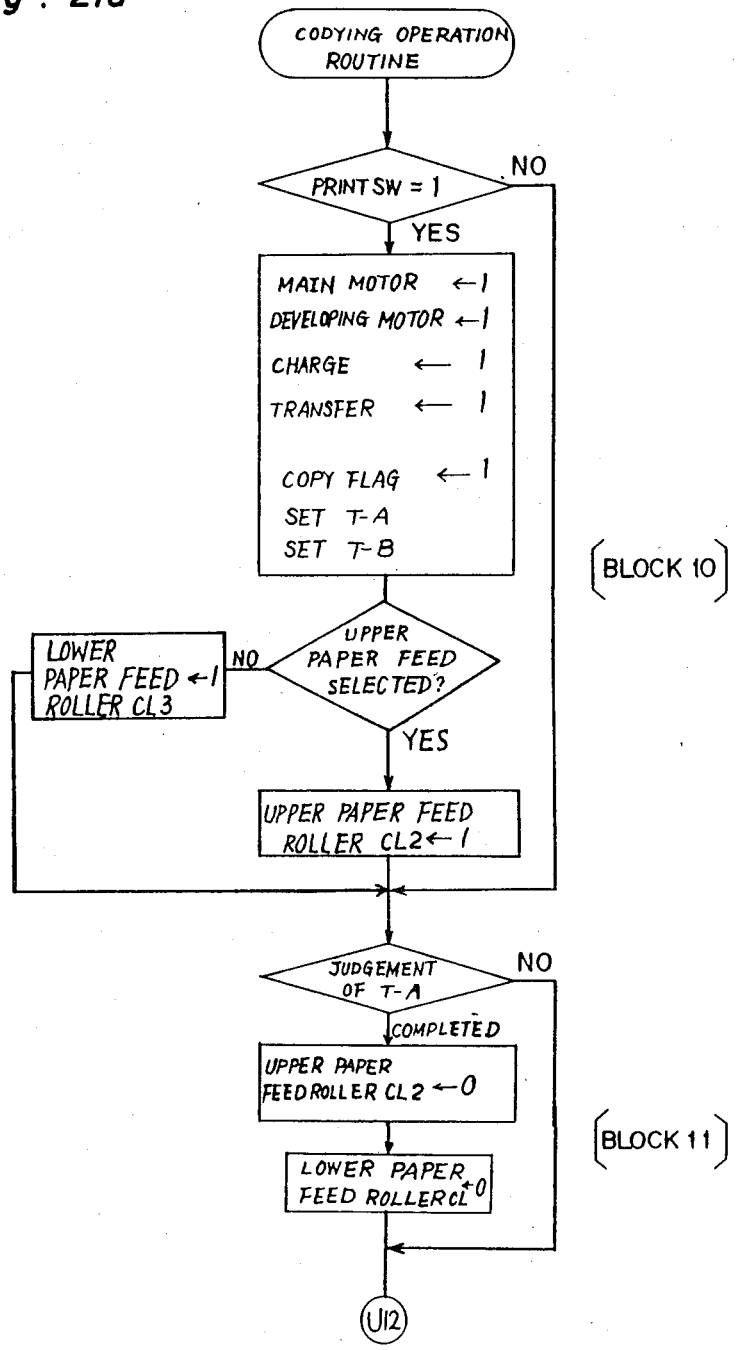
Figure 21B:
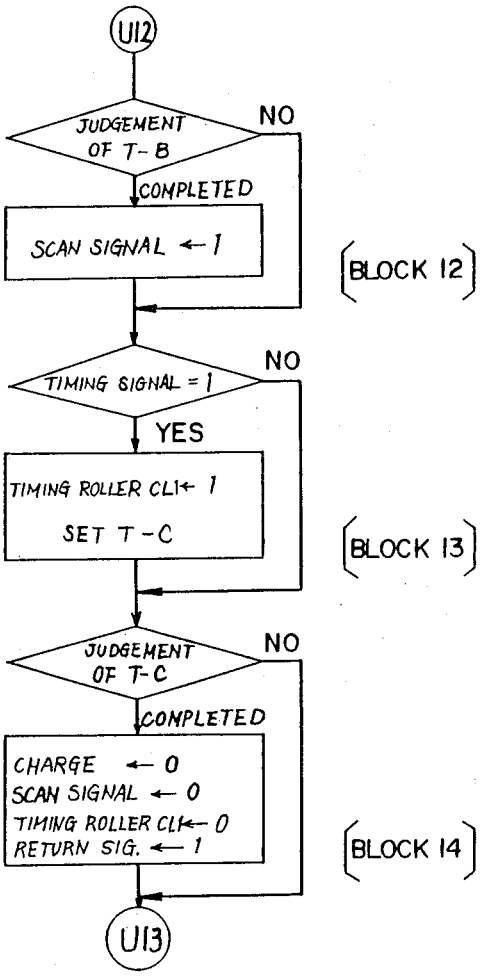
Figure 21C:
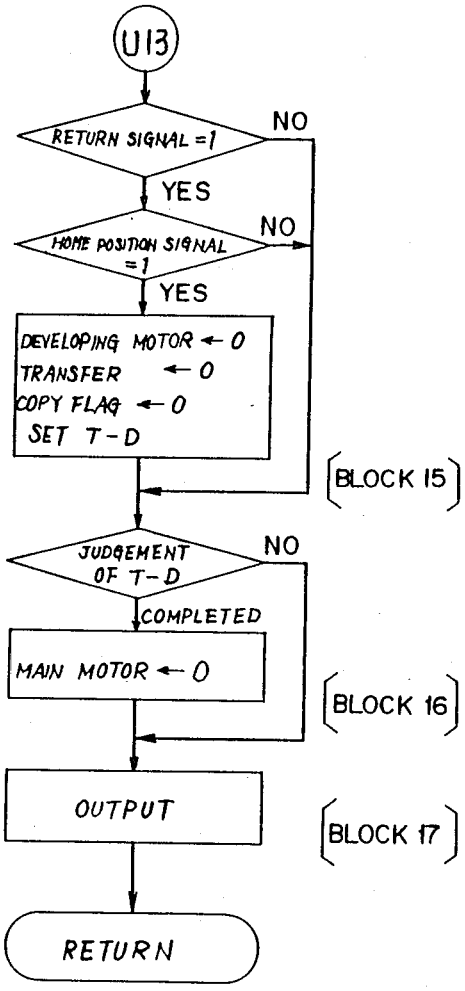
Figure 22:
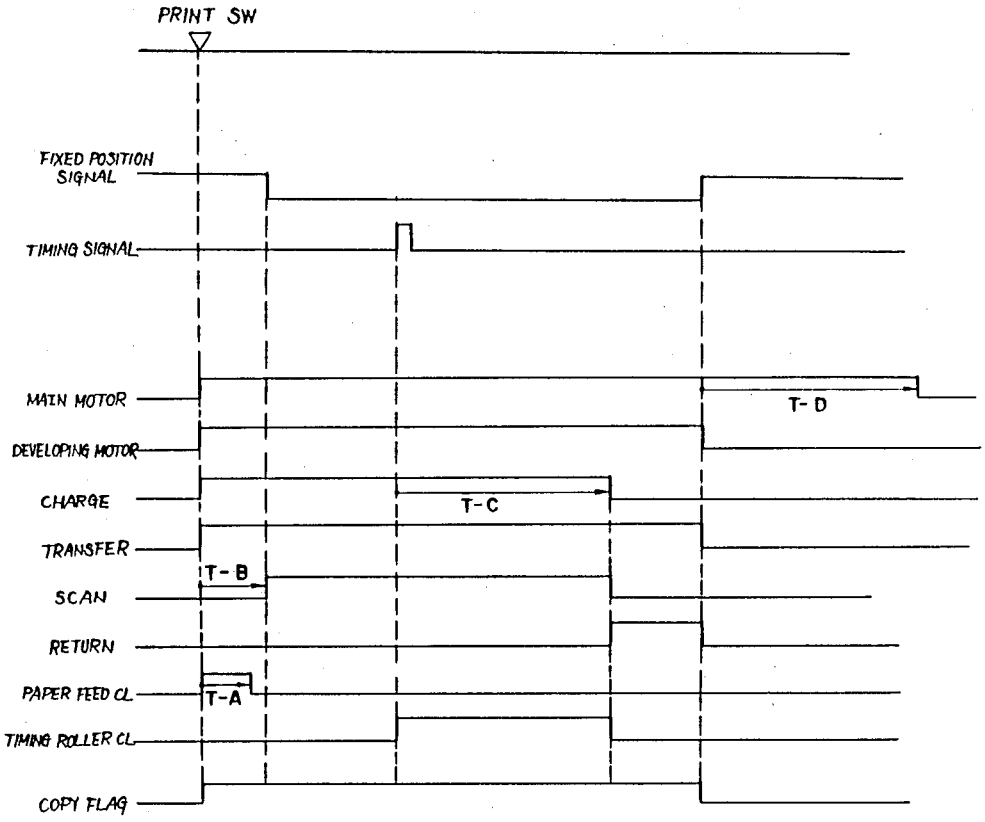
FIG. 22 is a time chart showing the operation of the essential portion of the control device used in the copying machine according to the present invention.

FIGS. 21*a* through 21*c* show a flow chart showing an example of operational control of the copying apparatus. This chart is now briefly described with reference to a time chart of FIG. 22.

In a block 10, when a print switch is turned on, the main motor M1, the developing motor M2, the corona charger 5 and the transfer charger 7 are respectively operated while a copy flag showing that the device is in copying operation is set at "1" and control timers T-A and T-B are driven to turn on the clutch of a selected paper feed roller.

In a block 11, a determination is made on completion of the operation of the timer T-A, to turn off the paper feed roller.

In a block 12, a determination is made on completion of operation of the timer T-B, to turn on a scan motor M3 for initiating the scanning operation.

In a block 13, a process is effected to turn on a timing roller clutch CL1 when a timing signal is generated during the scanning operation while setting a timer T-C. A copy sheet is transported in synchronization with an image on the photoreceptor drum 1 by a timing roller 26.

In a block 14, a determination is made on completion of operation of the timer T-C, to turn off the corona charger, and the timing roller clutch CL1, turning the return signal 1 so as to cause the scanner to return. The timer T-C may be set variable depending on factors such as the size of the utilized copy sheet.

In a block 15, the developing motor M2 and the transfer charger 7 are respectively turned off and the copy flag is set at "0" while a timer T-D is set when the optical system is returned to a home position following a returning operation to turn on a set position switch. The scan length and the number of LEDs to be lit in the copying routine are determined by the data set in the steps S464 and S465 and steps S468 and S469.

In a block 16, a determination is made on completion of operation of the timer T-D, to turn off the main motor M1.

In a block 17, a process is effected for various kinds of outputs.

The timers T-A through T-D described with respect to the aforementioned flow chart and time chart are digital timers which are programmed to be counted up by "1" per one routine of processing effected within a time period defined by an internal timer, and the time-up period is stored as a numerical data.

In the copying routine the respective LEDs are lit according to a pulse width modulation.

The operations mentioned above are shown in FIG. 23.

FIG. 23 shows a timer interruption routine in the first CPU 201, wherein the brightness of the LEDs 701 to 730 of the LED array 700 can be controlled by controlling the duty time thereof. First, the serial number of the LEDs 701 to 730 to be lit is set as the illuminating data.

Subsequently if the copying machine is in the preliminary scanning mode for detecting the original density or original illumination mode for confirming the copy available area, the LEDs to be illuminated is illuminated with a full power of 100% duty.

In the copying mode, in order to effect an exposure with a suitable exposure value for the entire original pattern obtained in the preliminary scanning, each of the LED is illuminated with a predetermined and calculated duty timing by counting the number of times of the interruption executed. For example, the LED for illuminating the high density part of the original is lit with a high duty cycle near 100% for a high brightness illumination, to the contrary, the LED illuminating the low density part of the original is lit with a low duty cycle for a low bright illumination.

Various functions provided in the copying machine mentioned above are explained below.

A copy can be made by turning on only the necessary number of LEDs of the LED array 700 conforming to the size of the original to be copied. This function enables to make a copy with the cover of the copying machine opened preventing the light from reaching the operator's eyes. The size of the original can be set by adjusting the position of the knobs in FIG. 3 and is taken in the control device according to the sub routine shown in FIG. 16. The number of LEDs to be turned on can be determined in the step S502 corresponding to the width of the original. The scan length also can be set corresponding to the input value by the arrangement shown in FIG. 3. Necessary number of the erasing LEDs of the LED array 800 are turned on corresponding to the area in which the LEDs of the LED array 700 are kept turned off so as to erase the charge on the photoreceptor 1.

When a part of the LEDs of the LED array 700 for illuminating the original are damaged, a copy can be made using the healthy LEDs. Detection of the fault of the LEDs is performed by the subroutine shown in FIG. 10. The available copy size can be displayed by the subroutine shown in FIG. 18 corresponding to the position of the fault LEDs. The user of the copying machine can select or change the size of the copying paper based on the display of the fault LEDs. In this case missing of the image on the copying paper does not occur. On the other hand, the operator can select a copy size larger than the size which is displayed as the available copy size. In this case, the image of the copy includes the missing part corresponding to the fault LED or LEDs. Assume that the LED 725 is in the fault condition. The LED 725 is situated in a position between one side edge of the A4 paper and one side edge of the B4 paper with other sides of both papers coincided with the standard line of the platform 16. The available copy sizes in this case are A4 and B5. If the user makes a copy directly, LEDs 701 to 726 receive the order of turning on corresponding to the size of B4 paper. However the fault LED 725 can not emit the light. Under such a state, instructions to turn on are fed to the erasing LED 825 corresponding to the fault LED 725 and the LEDs 827 to 830 corresponding to the blank space of the original of B4 size according to the sub routine shown in FIG. 19. By this operation, the part of the copied paper corresponding to the fault LED 725 is made white.

The width of the LEDs 701 to 730 to be turned on for illuminating the original can be defined by the input original size by the arrangement of FIG. 3 and the erasing LEDs of the array 800 corresponding to the LEDs of the array 700 which are kept turned off are turned on.

By setting the size of the original to be smaller than the actual size of the original, or by setting the size of the copy paper to be smaller than the size obtained by the multiplication between the size of the original and a copying magnification value, a partial copy can be made. By setting the size of the original smaller than the actual size, since only the LEDs for illuminating the original corresponding to the size thus set are turned on, the part corresponding to the turned on LEDs can be copied. If a small size paper is selected, despite that the image of the original is formed on the photoreceptor drum 1, the actual copy is made on the copy paper which is smaller than the original. In this way, a partial copy can be made.

In making the partial copy as mentioned above, it is difficult to place the original on the platform 16 so as to adjust the required part of the original. In order to facilitate to adjust the original in position for the partial copy, the original illuminating routine shown in FIG. 17 is provided. The routine can be executed by operation of the switch 108. In this sub routine, the entered width and length of the original are compared with the converted value obtained by the division of the width and length of the selected copy paper by the magnification value and the smaller length and width are selected and any of the LEDs 701 to 730 corresponding to the selected width are turned on and the original is scanned with the selected length. The scan speed is low for enabling to see the scanned area easily. The user can notice the relative position between the available copy area and the desired area of the original for copy by seeing the light of the LEDs passing the original.

Various modification can be made without departing from the spirit of the copying machine of present invention. For example, although in the above embodiment, LEDs for illuminating the original are turned on or off corresponding to the Japanese standard sizes such as A4, B5, B4, the LEDs can be turned on individually corresponding to the desired size of the copy. Also the copying machine according to the present invention can be applied to the center to center registration system.

Further, the light value of the respective LEDs can be controlled by varying the current applied to the respective LEDs instead of controlling the duty cycle ratio. The control of the light value of the respective LEDs can be varied so as to depend successively on detection of the original density. Furthermore, it may be considered in the illumination control of LED array 700 to add the characteristics of the optical system 10 such as $\cos^4 \theta$law.

What is claimed is:

1. A copying machine for copying an image of an original placed on a transparent platform by illuminating the original and projecting the image of the original on a photosensitive member using a slit system, said copying machine comprising;

an original illuminating means having a plurality of light emitting elements lined up in a row and movable relative to the original;

erasing means having a plurality of light emitting elements disposed corresponding to the respective light emitting elements of the the original illuminating means with a one to one relation and lined up in a row so as to be adjacent the photosensitive member;

means for inputting a size of an area to be copied;

means for detecting any fault in each of the light emitting elements of the original illuminating means;

control means for controlling the turning on and off of the rspective light emitting elements of the original illuminating means and the erasing means based on the output of the inputting means and the fault detecting means, and means for displayinmg the fault of any light emitting element.

2. The copying machine according to claim 1, further comprising means for determining an available copy size by the position of the light emitting element in fault condition and for displaying the available copy size.

3. The copying machine according to claim 1, further comprising means for permitting the making of a copy even if a fault in one or more light emitting elements of the original illuminating means is present in the area to be copied, wherein said control means acts to turn on one or more light emitting elements of the erasing means corresponding to the light emitting elements of the original illuminating means that have a fault in them.

4. A copying machine for copying an image of an original placed on a transparent platform by illuminating the original and projecting the image of the original on a photosensitive member using a slit system, said copying machine comprising:

an original illuminating means having a plurality of light emitting elements lined up in a row and movable relative to the original;

erasing means having a plurality of light emitting elements disposed corresponding to the respective light emitting elements of the original illuminating means with a one to one relation and lined up in a row so as to be positioned operatively adjacent the photosensitive member;

means for designating the area to be copied; and control means for controlling the turning on and off of the respective light emitting elements of the original illuminating means and the erasing means in accordance with the area to be copied so as to turn on both the necessary number of the light emitting elements of the original illuminating means corresponding to the area to be copied and the necessary number of the light emitting elements of the erasing means corresponding to an area of the photosensitive member that has been predetermined to provide the blank part of the area.

5. The copying machine according to claim 4 further comprising a plurality of light receiving elements disposed corresponding to the respective light emitting elements of the original illuminating means for receiving the light reflected from each part of the original illuminated by each of the light emitting elements, wherein said control means controls the light value of each of the light emitting elements of the original illuminating means corresponding to the light value received by the respective light receiving elements.

6. The copying machine according to claim 4 wherein the area to be copied is designated in accordance with the size of the original.

7. The copying machine according to claim 1 further comprising means for detecting the size of the copying paper and means for comparing the designated area and the detected size of the copying paper transmit the smaller one thereof.

8. The copying machine according to claim 9, further comprising means for detecting the size of the copying paper and means for comparing the designated size and the detected sizes for transferring the data representing the smaller one to the control means and the second control means.

9. The copying machine acording to cliam 1, further comprising a second control means for controlling the relative movement of the original illuminating means and means for indicating a confirmation mode to confirm a copy available area, wherein when the confirmation mode is set by the indicating means, said control means causes the number of the light emitting elements to be turned on corresponding to the size of the designated area and said second control means effects the relative movement of the original illuminating means corresponding to the distance of the size of the area, thereby showing the available area for copying by the light passing through the original.

10. The copying machine according to claim 9, wherein the scanning speed of the relative movement of the original illuminating means by the second control means in the confirmation mode is lower than the speed at the time of making copy.

11. A copying machine for copying an image of an original placed on a transparent platform by illuminating the original and projecting the image of the original on a photosensitive member using a slit system, said copying machine comprising:

an original illuminatig means having a plurality of light emitting elements lined up in a row and movable relative to the original;

erasing means having a pluality of light emitting elements disposed corresponding to the respective light emitting elements of the original illuminating means with a one to one relation and lined up in a row so as to oppose the photosensitive member;

means for designating the area to be copied;

control means for controlling the respective light emitting elements of the original illuminating means and the erasing means in accordance with the area to be copied so as to turn on both the necessary number of the light emitting elements of the original illuminating means corresponding to the area to be copied and the necessary number of the light emitting elements of the erasing means corresponding to an area of the photosensitive member of the blank part of the area, and means for detecting a fault condition of the light emitting elements of the original illuminating means, wherein said control means can turn on th elight emitting element of the erasing means corresponding to the light emitting element of the original illuminating means in the fault condition.

12. A copying machine for copying an image of an original placed on a transparent platform by illuminating the original and projecting the image of the original on a photosensitive member using a slit system, said copying machine comprising:

an original illuminating means having a plurality of light emitting elements lined up in a row and movable relative to the original;

means for designating an area to be copied;

means for setting a mode for confirming the copying area;

first control means for controlling the turning on and off of the respective light emitting elements of the original illuminating means corresponding to the area designated by the designating means;

second control means for controlling the relative movement of the original and the original illuminating means corresponding to the area designated by the designating means; and means, when the confirmation mode is set, for causing the first and second control means without copying to effect the relative movement of the original and the original illuminating means by a length corresponding to the designated area and the light emission of the requested number of the light emitting elements corresponding to the designated area.

13. The copying machine according to claim 12, wherein said indicating means includes means for inputting the size of the original to be copied.

14. The copying machine according to claim 12, wherein said indicating means includes means for inputting the size of the original to be copied, means for detecting the size of the copying paper and means for comparing the said both sizes and using the smaller size as the copying area.

15. The copying machine according to claim 12, wherein said indicating means includes inputting means for inputting the size of the original to be copied, means for instructing a copying magnification value and means for calculating a available copy size based on the copying magnification value and the size of the original, comparing the available copy size with the size of the original and taking the smaller one as the size of the copying area.

16. A copying machine for copying an image of an original placed on a transparent platform by illuminating the original and projecting the image of the original on a photosensitive member using a slit system, said copying machine comprising:

an original illuminating means having a plurality of light emitting elements lined up in a row and movable relative to the original;

a plurality of light receiving elements provided corresponding to the respective light emitting elements of the original illuminating means with a one to one relation therebetween for receiving light reflected from a part of the original to be illuminated by the original illuminating means;

means for designating the area to be copied;

first control means for controlling the original illuminating means so as to turn on the necessary number of the light emitting elements corresponding to the area designated by the designating means and second control means for controlling the light amount of the respective light emitting elements that are turned on by the first control means in accordance with the light amount received by the respective light receiving elements corresponding to the turned on light emitting elements.

17. The copying machine according to claim 16, wherein said light emitting elements are light emitted diodes and said control means controls the duty of the power supply to the light emitted diodes.

18. The copying machine according to claim 16, further comprising means for causing the relative movements of the original and the original illuminating means to effect actual movement for the copy formation and preliminary movement prior to the actual movement, wherein the light receiving elements measure the density of the original during the preliminary movement and the second control means controls the light emitted by the respective light emitting elements to maintain them constant during the preliminary movement and to vary the light emitted in accordance with the measured density during the actual movement for copying.

19. A copying machine for copying an image of an original placed on a transparent platform by illuminating the original and projecting the image of the original on a photosensitive member using a slit system, said copying machine comprising:

an original illuminating means having a plurality of light emitting elements lined up in a row and movable relative to the original;

erasing means having a plurality of light emitting elements corresponding of the respective light emitting elements of the original illuminating means with a one to one relationship and lined up in a row so as to oppose the photosensitive member;

means for detecting any fault condition of the light emitting elements of the original illuminating means, and control means for controlling the turning on and of of the respective light emitting elements of the original illuminating means and the erasing means based on the predetermined copying conditions, wherein said control means can control the turning on of the light emitting element of the erasing means that corresponds to the light emitting elements of the original illuminating means that is in a fault condition.

20. A copying machine for copying an image of an original placed on a transparent platform by illuminating the original and projecting the image of the original on a photosensitive member using a slit system, said copying machine comprising:

an original illuminating means having a plurality of light emitting elements positioned in an array and movable relative to the orginal;

erasing means having a plurality of light emitting elements disposed in position corresponding to the respective light emitting elements of the original illuminating means with a corresponding relationship relative to the photosensitive member;

means for inputting a size of an area to be copied;

means for detecting the operativeness of each of the light emitting elements of the original illuminating means;

means for determining an available copy size by the position of the light emitting elements that are inoperative and for displaying the available copy size;

control means for controlling the turning on and off of the respective light emitting elements of the original illuminating means and the erasing means based on the output of the inputting means and the detecting means, and means for displaying the inoperativeness of any light emitting elements.

* * * * *